US006710693B2

(12) United States Patent
Matsumoto et al.

(10) Patent No.: US 6,710,693 B2
(45) Date of Patent: Mar. 23, 2004

(54) INDUCTOR COMPONENT CONTAINING PERMANENT MAGNET FOR MAGNETIC BIAS AND METHOD OF MANUFACTURING THE SAME

(75) Inventors: Hatsuo Matsumoto, Sendai (JP); Toru Ito, Miyagi (JP); Masahiro Kondo, Sendai (JP); Ryutaro Isoda, Sendai (JP); Toshiya Sato, Sendai (JP); Tadakuni Sato, Sendai (JP); Teruhiko Fujiwara, Sendai (JP); Masayoshi Ishii, Sendai (JP); Haruki Hoshi, Sendai (JP)

(73) Assignee: NEC Tokin Corporation, Sendai (JP)

( * ) Notice: Subject to any disclaimer, the term of this patent is extended or adjusted under 35 U.S.C. 154(b) by 0 days.

(21) Appl. No.: 10/104,799

(22) Filed: Mar. 22, 2002

(65) Prior Publication Data

US 2002/0190830 A1 Dec. 19, 2002

(30) Foreign Application Priority Data

Mar. 23, 2001 (JP) ..... 2001-084268
Mar. 26, 2001 (JP) ..... 2001-088088

(51) Int. Cl.[7] ..... H01F 21/00

(52) U.S. Cl. ..... 336/110; 336/83; 336/178; 336/200

(58) Field of Search ..... 336/83, 110, 200, 336/233, 178; 148/105, 108; 428/900

(56) References Cited

U.S. PATENT DOCUMENTS 4,627,407 A * 12/1986 Betz ..... 123/634
5,464,670 A * 11/1995 Ikuma et al. ..... 248/35.8
6,328,817 B1 * 12/2001 Murakami ..... 148/105

FOREIGN PATENT DOCUMENTS

JP 62-234302 * 10/1987

* cited by examiner

*Primary Examiner*—Tuyen T. Nguyen
(74) *Attorney, Agent, or Firm*—Frishauf, Holtz, Goodman & Chick, P.C.

(57) ABSTRACT

An inductor component contains a drum magnetic core made of a magnetic material having a structure including integrated flanges at both ends of a columnar material, a coil wound around the columnar material in the drum magnetic core and placed between the flanges, and a permanent magnet placed in the neighborhood of the drum magnetic core with the coil wound around. This inductor component contains a sleeve core fitted to the outside of the drum magnetic core. The permanent magnet is placed in at least one gap in a closed magnetic circuit formed with the drum magnetic core and the sleeve core in order to apply a direct-current magnetic field in the direction opposite to the direction of a magnetic field generated by a magnetomotive force due to the coil.

15 Claims, 12 Drawing Sheets

INDUCTOR COMPONENT CONTAINING PERMANENT MAGNET FOR MAGNETIC BIAS AND METHOD OF MANUFACTURING THE SAME

BACKGROUND OF THE INVENTION

1. Field of the Invention

The present invention relates to a magnetic element containing a coil wound around a magnetic core. In particular, the present invention relates to an inductor component, for example, a transformer and inductor, used for a step-up and step-down choke coil, transformer, power transformer, etc., for an inverter switching power supply and applied with a direct-current bias.

2. Description of the Related Art

Hitherto, the aforementioned type of inductor component has been configured as follows. First, a coil has been wound around a columnar material in a drum magnetic core. The magnetic core has been made of a magnetic material and has had a structure including integrated disk flanges at both ends of the columnar material. A cylindrical insulating material has been placed on the periphery thereof. A cylindrical sleeve core has been further placed on the periphery of the insulating material. A terminal has been placed at a predetermined position in the neighborhood of the bottom portion of the cylindrical sleeve core in order to connect with a lead wire of the coil end portion.

Regarding the inductor component based on the conventional technique, the cylindrical sleeve core is fitted to the outside of the drum magnetic core and, thereafter, the cylindrical insulating material is inserted into the joint portion of the drum magnetic core and the cylindrical sleeve core. Consequently, a gap is included in the configuration, a magnetic field $H_s$ is generated by a magnetomotive force; due to the coil, and the magnetic field $H_5$ acts from one flange toward the other flange side.

Accompanying recent miniaturization and weight reduction of electronic apparatuses, demand for miniaturization has occurred with respect to inductors and transformers used for power supply portions. When a whole structure is miniaturized, a drum magnetic core becomes likely to magnetically saturate and, therefore, a problem occurs in that a treatable current is reduced. Regarding the aforementioned configuration of the inductor component, this problem can be overcome by enlarging the gap due to the insulating material. However, the number of turns of the coil must be increased because a value of inductance is reduced and, therefore, realization of miniaturization is hindered.

Some inductor components have overcome such a problem. In the configuration of an example of the aforementioned inductor components, a coil is wound around a columnar material between flanges at both ends of the drum magnetic core made of a magnetic material and having a structure including integrated disk flanges at both ends of the columnar material, a cylindrical permanent magnet is placed on the periphery thereof, and a terminal is formed on a predetermined position in the neighborhood of the bottom portion of the permanent magnet in order to connect with a lead wire of the coil end portion.

That is, regarding this inductor component, a cylindrical permanent magnet is placed instead of the sleeve core on the outside of the drum magnetic core while the south pole side is arranged at one flange side and the north pole side is arranged at the other flange side. According to such a configuration, the magnetic field $H_s$ is generated by a magnetomotive force due to the coil, and acts from one flange toward the other flange. A magnetic field $H_M$ due to the permanent magnet acts to obstruct this magnetic field $H_s$. Consequently, the treatable current can be increased by application of a magnetic bias.

Regarding this inductor component of magnetic bias application-type, the drum magnetic core is manufactured by using a Ni—Zn-type ferrite powder, compact molding by a press method, thereafter sintering or pressing the ferrite powder into the shape of a cylinder column, sintering, and, thereafter machining so as to manufacture the flange portions and, therefore, the drum magnetic core is manufactured. The permanent magnet for applying a magnetic bias is manufactured by the steps of performing compact molding of a powder of Sr ferrite, Ba ferrite, etc., by a press method and, thereafter, performing sintering, and is integrally joined using an adhesive, etc., at the time of fitting to the drum magnetic core with a coil wound around.

The following disadvantages are listed with respect to the inductor component of magnetic bias application-type based on the conventional technique.

The first problem is in that since an open magnetic circuit is configured without the use of sleeve core in the adopted structure, leakage flux is likely to increase and affect the surroundings and, therefore, measures for magnetic shielding cannot be taken adequately.

The second problem is in that the open magnetic circuit is configured without the use of sleeve core in the adopted structure, the effective permeability is reduced, the inductance is reduced, and, therefore, the coil must have a large number of turns (the coil is long-wound) in order to achieve a required inductance value resulting in hindrance of miniaturization The third problem is in that when a ferrite powder is used for the permanent magnet, thermal demagnetization is likely to occur accompanying heating during the step of reflow soldering and demagnetization is likely to occur due to an excessive current and, therefore, the magnetic characteristics of the permanent magnet are likely to be degraded.

The fourth problem is in that when a metal-based material is used for the permanent magnet, an eddy current loss is increased due to the low resistivity, permanent demagnetization occurs due to proceeding of oxidation with time and, therefore, initial characteristics cannot be maintained as the magnetic characteristics. This problem is fatal to the reliability.

SUMMARY OF THE INVENTION

Accordingly, it is an object of the present invention to provide an inductor component capable of treating a large current, having magnetic characteristics unlikely to be degraded, and suitable for taking measures for magnetic shielding, miniaturization, and weight reduction with ease.

It is another object of the present invention to provide an inductor component capable of reducing the processing cost based on shortening of the process by performing the step of magnetization of the permanent magnet and the step of adhesion and fixing of the permanent magnet to the magnetic core in a single step.

It is still another object of the present invention to provide a manufacturing method for the aforementioned inductor component.

According to an aspect of the present invention, there is provided an inductor component which contains a drum magnetic core made of a magnetic material having a structure including integrated flanges at both ends of a columnar material, a coil wound around the columnar material in the drum magnetic core and placed between the flanges, and a permanent magnet placed in the neighborhood of the drum magnetic core with the coil wound around. A sleeve core is fitted to the outside of the drum magnetic core. The permanent magnet is placed in at least one gap in a closed magnetic circuit formed with the drum magnetic core and the sleeve core in order to apply a direct-current magnetic field in the direction opposite to the direction of a magnetic field generated by a magnetomotive force due to the coil.

According to another aspect of the present invention, there is provided a manufacturing method for an inductor component is provided. The inductor component contains a drum magnetic core made of a magnetic material having a structure including integrated flanges at both ends of a columnar material, a coil wound around the columnar material in the drum magnetic core and placed between the flanges, and a permanent magnet placed in the neighborhood of the drum magnetic core with the coil wound around. The manufacturing method includes the steps of fitting a sleeve core to the outside of the drum magnetic core, and placing the permanent magnet in at least one gap in a closed magnetic circuit formed with the drum magnetic core and the sleeve core in order to apply a direct-current magnetic field in the direction opposite to the direction of a magnetic field generated by a magnetomotive force due to the coil.

DESCRIPTION OF THE PREFERRED EMBODIMENTS

In order to make easy to understand the present invention, inductor components based on the conventional technique will be described with reference to FIGS. 1A, 1B, 2A, and 2B before Examples according to the present invention are described.

Figure 1A:
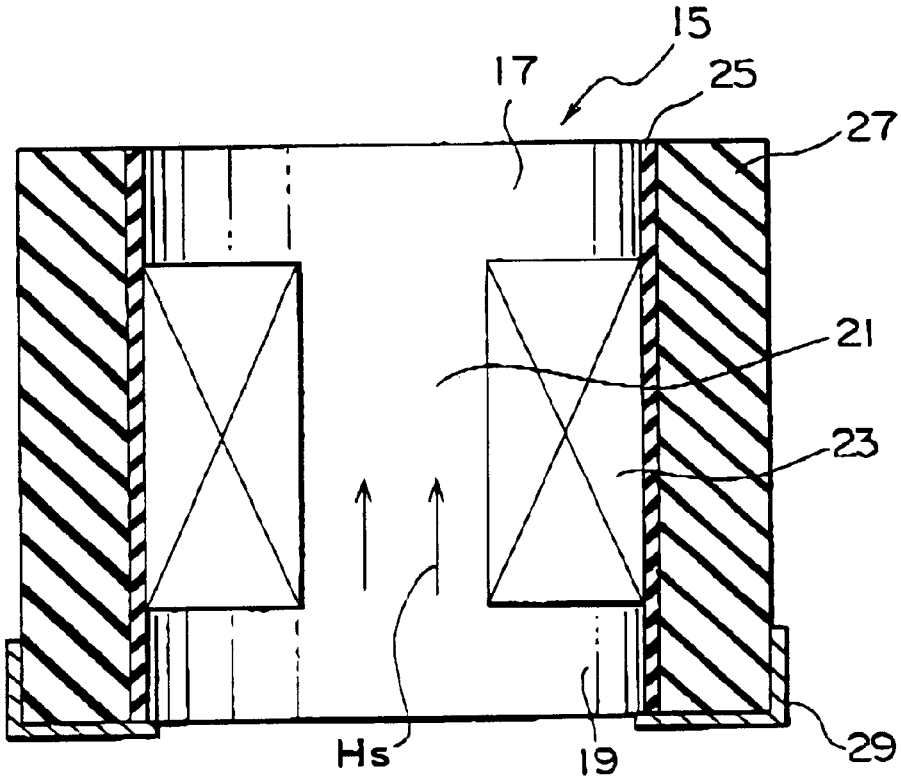
FIG. 1A is a sectional side view showing a basic configuration of an example of conventional inductor components.
Figure 1B:
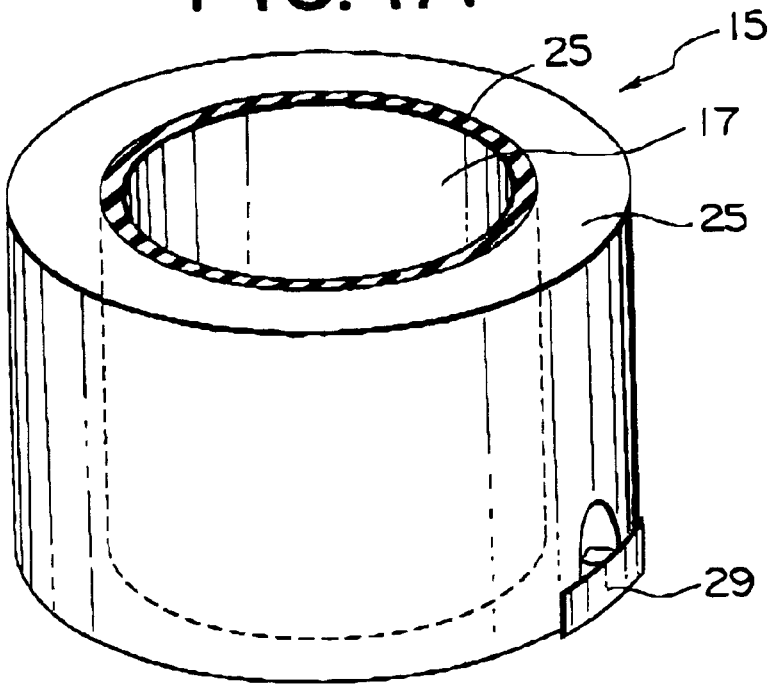
FIG. 1B is a perspective view of the inductor component shown in FIG. 1A.

As shown in FIGS. 1A and 1B, an inductor component 15 contains a drum magnetic core 21, a coil 23, a cylindrical insulating material 25, and a cylindrical sleeve core 27. The drum magnetic core 21 is made of a magnetic material having a structure including integrated disk flanges 17 and 19 at both ends of a columnar material. The coil 23 is wound around the columnar material in the drum magnetic core 21, and is placed between the flanges 17 and 19. The insulating material 25 is placed on the periphery of the drum magnetic core 21 with the coil 23 wound around. The cylindrical sleeve core 27 is placed on the periphery of the insulating material 25. A terminal 29 is placed at a predetermined position in the neighborhood of the bottom portion of the cylindrical sleeve core 27 in order to connect with a lead wire of the end portion of the coil 23.

That is, regarding this inductor component 15, the cylindrical sleeve core 27 is fitted to the outside of the drum magnetic core 21 and, thereafter, the cylindrical insulating material 25 is inserted into the joint portion of the drum magnetic core 21 and the cylindrical sleeve core 27. Consequently, a gap is included in the configuration, a magnetic field $H_s$ is generated by a magnetomotive force due to the coil, and the magnetic field $H_s$ acts from the flange 19 toward the flange 17 side.

Accompanying recent miniaturization and weight reduction of electronic apparatuses, demand for miniaturization has occurred with respect to inductors and transformers used for power supply portions. When a whole structure is miniaturized, the drum magnetic core 21 becomes likely to magnetically saturate and, therefore, a problem occurs in that a treatable current is reduced. Regarding the aforementioned configuration of the inductor component 15, this problem can be overcome by enlarging the gap due to the insulating material 25. On the other hand, the number of turns of the coil 23 must be increased because a value of inductance is reduced and, therefore, realization of miniaturization is hindered.

Some inductor components have been developed and have overcome such a problem. An example of the aforementioned inductor components has a configuration shown in FIGS. 2A and 2B. Similar portions to FIGS. 1*a* and 1*b* will be represented by the same reference numbers hereinafter.

Figure 2A:
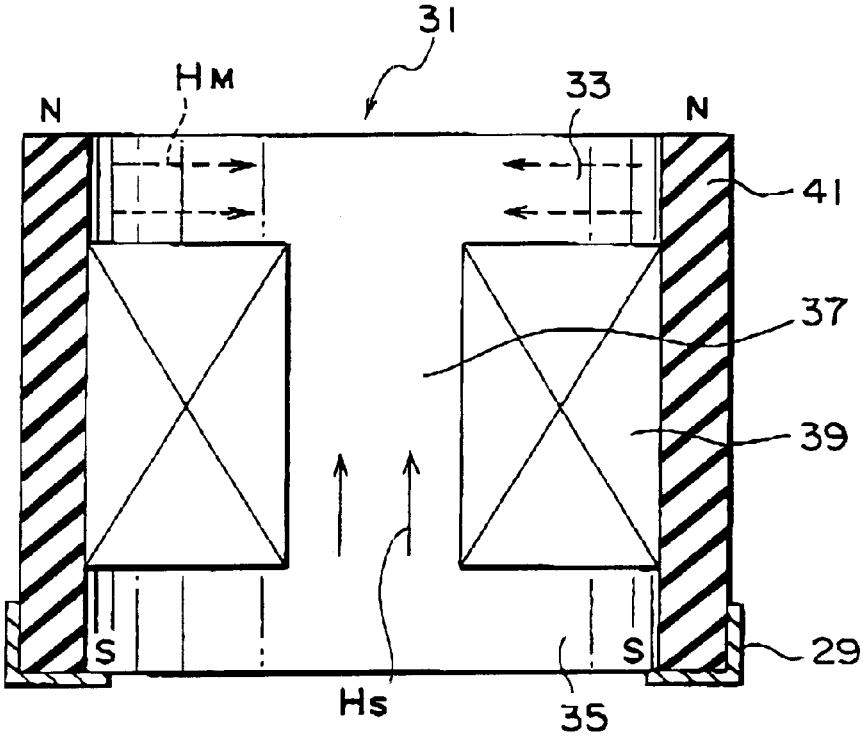
FIG. 2A is a sectional side view showing a basic configuration of another example of conventional inductor components.
Figure 2B:
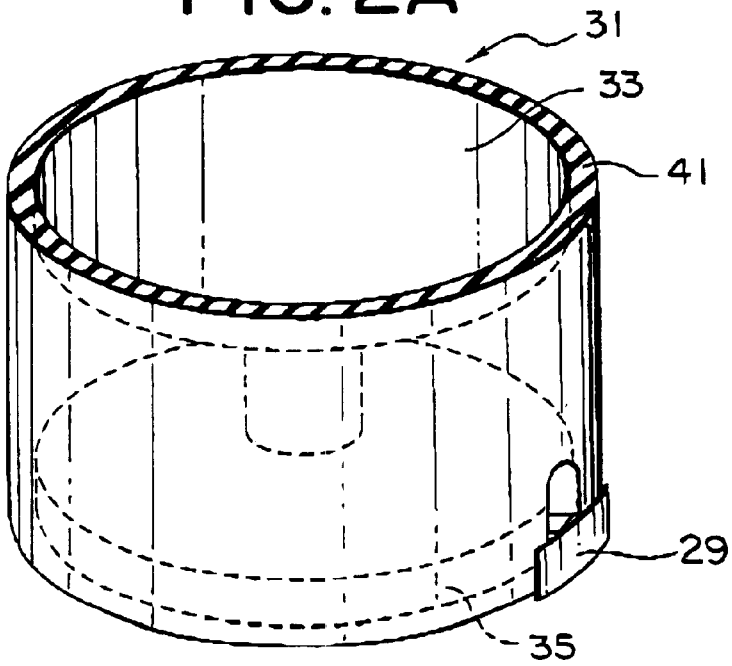
FIG. 2B is a perspective view of the inductor component shown in FIG. 2A.

As shown in FIGS. 2A and 2B, an inductor component 31 contains a drum magnetic core 37, a coil 39, and a cylindrical permanent magnet 41. The drum magnetic core 37 is made of a magnetic material having a structure including integrated disk flanges 33 and 35 at both ends of a columnar material. The coil 39 is wound around the columnar material in the drum magnetic core 37, and is placed between the flanges 33 and 35. The permanent magnet 41 is placed on the periphery of the drum magnetic core 37 with the coil 39 wound around. A terminal 29 is placed at a predetermined position in the neighborhood of the bottom portion of the permanent magnet 41 in order to connect with a lead wire of the end portion of the coil 39.

That is, regarding this inductor component 31, the cylindrical permanent magnet 41 is placed instead of the sleeve core on the outside of the drum magnetic core 37 while the south pole side is arranged at the flange 35 side and the north pole side is arranged at the flange 33 side. According to such a configuration, the magnetic field $H_s$ is generated by a magnetomotive force due to the coil 39, and acts from the flange 35 toward the flange 33 side. A magnetic field $H_M$ due to the permanent magnet 41 acts to obstruct this magnetic field $H_s$. Consequently, treatable current can be increased by application of a magnetic bias.

Regarding this inductor component 37 of magnetic bias application-type, a Ni—Zn-type ferrite powder is used, compact molding is performed by a press method and, thereafter, sintering is performed, or the ferrite powder is pressed into the shape of a cylindrical column, sintering is performed, and, thereafter, machining is performed, so as to manufacture the flange portions and, therefore, the drum magnetic core 37 is manufactured. The permanent magnet 41 for applying a magnetic bias is manufactured by the steps of performing compact molding of a powder of Sr ferrite, Ba ferrite, etc., by a press method and, thereafter, performing sintering, and, is integrally joined using an adhesive, etc., at the time of fitting to the drum magnetic core 37 with the coil 39 wound around.

Examples according to the, present invention will be described in detail with reference to the drawings.

First, a technical outline of the inductor component according to the present invention will be described briefly. The basic configuration of this inductor component contains the drum magnetic core made of the magnetic material having the structure including integrated flanges at both ends of the columnar material, the coil wound around the columnar material in the drum magnetic core and placed between the flanges, and the permanent magnet placed in the neighborhood of the drum magnetic core with the coil wound around. The sleeve core is fitted to the outside of the drum magnetic core. The permanent magnet is placed in at least one gap in a closed magnetic circuit formed with the drum magnetic core and the sleeve core in order to apply a direct-current magnetic field in the direction opposite to the direction of a magnetic field (direction of the magnetic flux) generated by a magnetomotive force due to the coil.

Figure 3A:
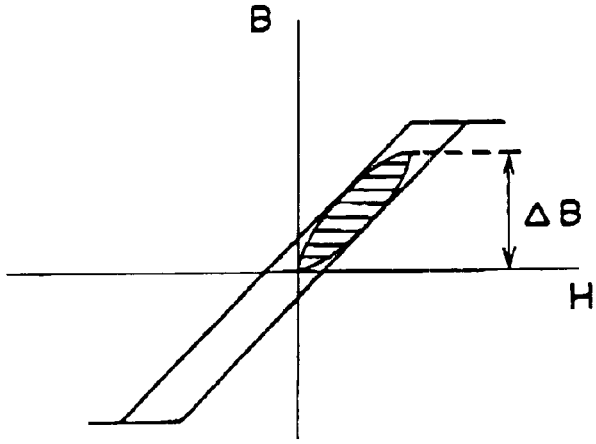
FIG. 3A is a diagram showing a magnetic flux density B-magnetic field H characteristic containing a magnetic flux density width ΔB before application of a magnetic bias for explaining a magnetic bias effect due to an inductor component according to the present invention.
Figure 3B:
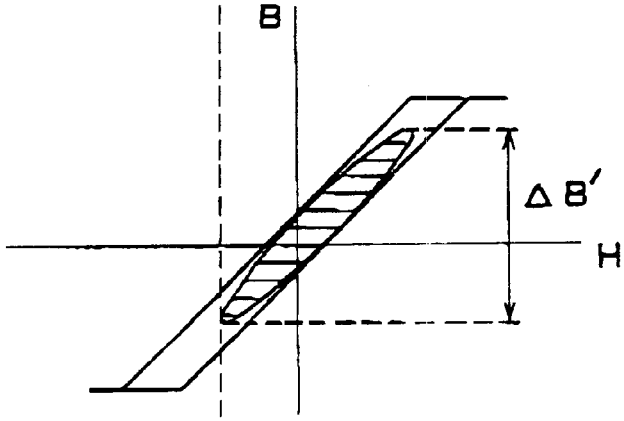
FIG. 3B is a diagram showing a magnetic flux density B-magnetic field H characteristic containing a magnetic flux density width ΔB' after application of the magnetic bias.

Referring to FIG. 3A, it is provided that the magnetic core has a magnetic hysteresis loop which is shown by a rectangular loop on a H-B coordinate system. When a inductor using the magnetic core is used for a pulse signal without application of a magnetic bias, a magnetic flux density width $\Delta B$ can actually be used in a first quadrant of the H-B coordinate system, taking into consideration that the magnetic core is degraded in the magnetic properties if is used to be magnetically saturated. On the other hand, when the magnetic core is magnetically bias by use of the permanent magnet so that the origin is resultantly displaced into the third quadrant of the coordinate system as shown by dotted axes in FIG. 3B, a usable magnetic flux density width $\Delta B'$ can be increased by a significant degree.

Figure 3C:
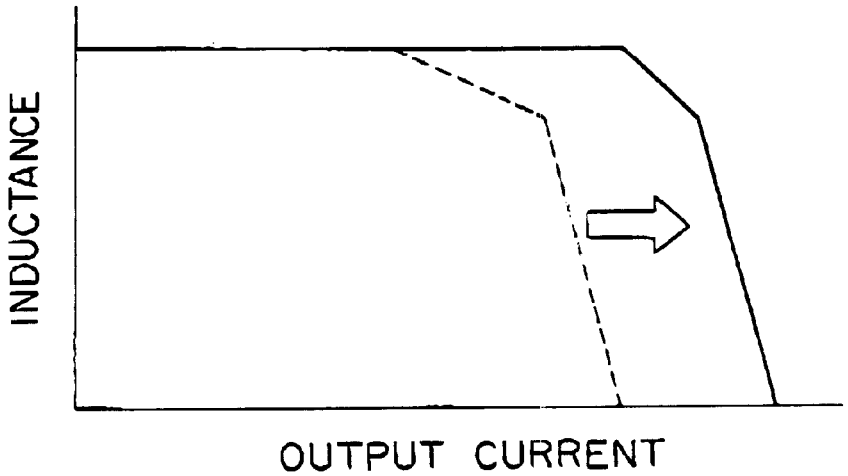
FIG. 3C is a diagram showing direct-current superimposed inductance characteristic (change thereof) due to a magnetic bias indicated by the relationship of the inductance relative to the output current.

In general, since the usable magnetic flux density widths $\Delta B$ and $\Delta B'$ are inversely proportional to the number of turns of the coil in the inductor component, the number of turns can be decreased by enlargement of the magnetic flux density width $\Delta B'$ and, therefore, this contributes significantly to reduced loss, miniaturization, and reduced weight of the inductor component. When such an inductor component is applied to a transformer or a step-up and step-down coil, an operating power Po can be represented by a relational expression $Po=\kappa\cdot(\Delta B')^2\cdot f$ wherein $\kappa$ denotes a proportionality constant, and f denotes a driving frequency. Therefore, the operating power Po increases in proportion to the square of the $\Delta B'$ by a large degree. The enlargement of the $\Delta B'$ indicates that the treatable current or output current can be increased by a large degree in direct-current superimposed inductance characteristic, as is shown by an amount of movement from a dotted line to a solid line indicated with an arrow in FIG. 3C.

Furthermore, regarding the structure of the inductor component according to the present invention, a conventional open magnetic circuit using no sleeve core is not configured, while the permanent magnet is inserted into the gap in the closed magnetic circuit formed by the drum magnetic core and the sleeve core in the configuration. Consequently, leakage flux due to configuration of the open magnetic circuit can be reduced by a large degree, and measures for magnetic shielding can be taken adequately.

In the inductor component according to the present invention, preferably, the permanent magnet is made by dispersing a rare-earth magnet powder having an intrinsic coercive force $H_c$ of $7.9\times10^5$ (A/m) or more, a Curie temperature $T_c$ of 500° C. or more and an average powder particle diameter of 2.5 to 25 $\mu$m in at least one resin selected from the group consisting of poly(amide-imide) resins, polyimide resins, epoxy resins, poly(phenylene sulfide) resins, silicone resins, polyester resins, aromatic polyamide resins, and liquid crystal polymers. Preferably, the surface of the magnet powder is coated with at least one metal selected from the group consisting of Zn, Al, Bi, Ga, In, Mg, Pb, Sb, and Sn or an alloy, the content of the resin is 30% or more on a volume ratio basis, and the resistivity is 0.1 Ωcm or more. Preferably, the rare-earth magnet powder used for this; permanent magnet has a SmCo-based composition, specifically, has a composition of $Sm(Co_{bal}\cdot Fe_{0.15\ to\ 0.25}Cu_{0.05\ to\ 0.06}Zr_{0.02\ to\ 0.03})_{7.0\ to\ 8.5}$, and has a maximum particle diameter of 50 $\mu$m or less.

By using the SmCo-based magnetic powder having a high Curie temperature $T_c$ and intrinsic coercive force $H_c$ for the permanent magnet as described above, thermal demagnetization does not occur even in a heated state during a step of reflow soldering and, furthermore, demagnetization due to destruction of coercive force $H_c$ does not occur even when a direct-current magnetic field is applied by an excessive current, so that initial characteristics can be maintained. By kneading the SmCo-based magnetic powder with the resin at a volume ratio of 30% or more, the resistivity can be increased, and the eddy current loss of the permanent magnet can be reduced by a large degree.

In the inductor component of the present invention, when the SmCo-based magnetic powder is coated with inorganic glass having a softening point of 220° C. or more, but 550° C. or less, or the metal or alloy applied to the magnetic powder by coating is coated with a nonmetallic inorganic compound having a melting point of 300° C. or more, it is possible to prevent demagnetization due to proceeding of oxidation with time. The addition amount of these inorganic glass or nonmetallic inorganic compound is preferably within the range of 0.1% to 10% on a volume ratio basis.

In addition, as an embodiment, when the SmCo-based magnetic powder used for the permanent magnet is orientated in the direction of the thickness with a magnetic field so as to have magnetic anisotropy, and the permanent magnet is manufactured with a magnetizing magnetic field of 2.5 T or more so as to have a center line average roughness Ra of 10 $\mu$m or less, the resulting inductor component can be effectively applied in various fields.

The detailed configuration of the inductor component according to the present invention will be specifically described below using some Examples.

EXAMPLE 1

Figure 4A:
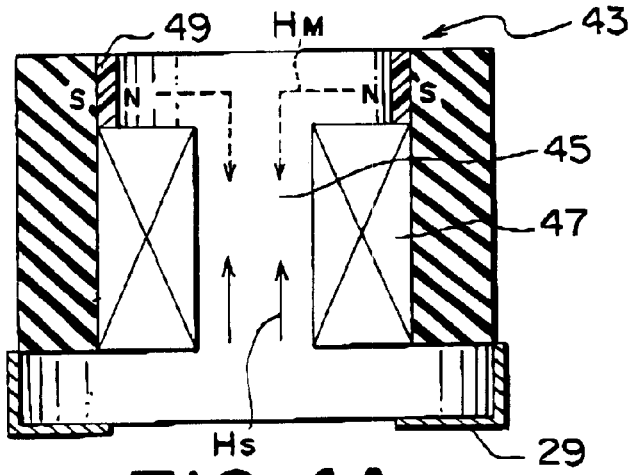
FIG. 4A is a sectional side view showing a basic configuration of an inductor component according to Example 1 of the present invention.

Regarding the basic configuration shown in FIG. 4A, an inductor component 43 according to Example 1 contains a drum magnetic core 45, a coil 47, a sleeve core, and a permanent magnet 49.

The drum magnetic core 45 is made of a magnetic material having a structure including integrated flanges of different sizes at both ends of a columnar material. The coil 47 is wound around the columnar material in the drum magnetic core 45 and is placed between the flanges. The sleeve core is in contact with the outer edge of the major flange in the drum magnetic core 45 with the coil 47 wound around, and is placed on the periphery of the minor flange and the coil 47. The permanent magnet 49 is placed in the gap in a closed magnetic circuit formed with the drum magnetic core 45 and the sleeve core, and on the periphery of the minor flange (that is, placed by insertion into the gap between the minor flange in the drum magnetic core 45 and the sleeve core) in order to apply a direct-current magnetic field $H_M$ in the direction opposite to the direction of a magnetic field $H_s$ (direction of the magnetic flux) generated by a magnetomotive force due to the coil 47. A terminal 29 is placed at a predetermined position in the neighborhood of the bottom portion of the major flange in order to connect with a lead wire of the end portion of the coil 47.

An embodiment of the inductor component will be described with reference to FIG. 4B. This inductor component is formed into the shape of a cylindrical column as a whole based on the basic configuration shown in FIG. 4A. That is, the columnar material in the drum magnetic core 45 is a cylindrical column-shaped material, the major flange is a disk-shaped lower flange 51, and the minor flange is a disk-shaped upper flange 53. The permanent magnet 49 is in the shape of a cylinder, and thy sleeve core is a cylindrical sleeve core 55.

Another embodiment of the inductor component will be described with reference to FIG. 40. This inductor component is formed into the shape of a quadrangular prism as a whole based on the basic configuration shown in FIG. 4A. That is, the columnar material in the drum magnetic core 45 is a quadrangular prism-shaped material, the major flange is a quadrangular plate-shaped lower flange 57, and the minor flange is a quadrangular plate-shaped upper flange 59. The permanent magnet 49 is in the shape of a quadrangular tube, and the sleeve core is a quadrangular tube-shaped sleeve core 61.

In either shape of inductor component, the drum magnetic core 45 is manufactured by performing the steps of pressing the Ni—Zn-based ferrite powder into the shape of a cylindrical column or quadrangular prism, calcining, cutting into the shape of a drum, and sintering. The steps of pressing into the shape of a cylindrical column or quadrangular prism and sintering may be performed in advance and, thereafter, cutting may be performed. However, in this case, although accuracy of dimension is increased, cost is increased disadvantageously. The cylindrical sleeve core 55 or quadrangular tube-shaped sleeve core 61 are manufactured using the Ni—Zn ferrite powder by performing the steps of pressing into the shape of a cylinder or quadrangular tube and sintering.

Figure 4B:
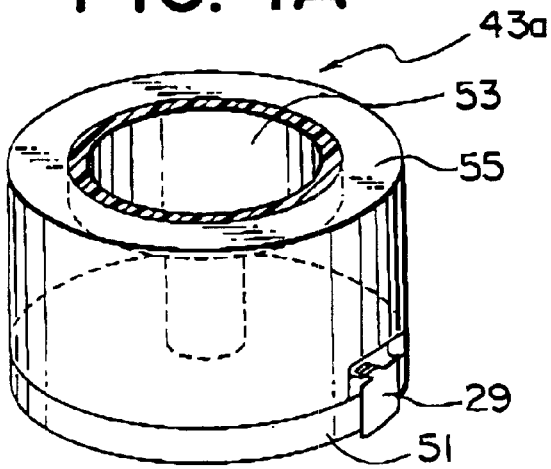
FIG. 4B is a perspective view of an embodiment of the inductor component shown in FIG. 4A.

In the embodiment shown in FIG. 4B, a rare-earth magnet powder was used for the permanent magnet 49. The rare-earth magnet powder had a composition of $Sm(Co_{0.742}Fe_{0.20}Cu_{0.055}Zr_{0.029})_{7.7}$, an average particle diameter of 5 $\mu$m, a maximum particle diameter of 45 $\mu$m, an intrinsic coercive force $H_c$ of $15.8\times10^5$ (A/m), and a Curie temperature $T_c$ of 770° C. The surface of the rare-earth magnet powder was coated with Zn, and as a binder, a poly(amide-imide) resin was mixed and molded at a volume ratio of 40%, so that the resistivity was made to be 0.5 Ωcm or more.

Regarding the configuration of the drum magnetic core 45 and the cylindrical sleeve core 55 used herein, for example, the magnetic path length is 1.85 cm, the effective cross-sectional area is 0.07 $cm^2$, and the gap is 150 $\mu$m. For example, the coil 47 is wound with 15 turns, the direct-current resistance is 20 mΩ, and the thickness of the permanent magnet 49 is 120 $\mu$m.

As comparative examples, prototype inductor components were manufactured. One inductor component had the configuration shown in FIGS. 1A and 1B, and had a magnetic path length of 1.85 cm and an effective cross-sectional area of 0.07 $cm^2$. The thickness of an insulating material 25 was 75 $\mu$m. The other inductor component had the configuration shown in FIGS. 2A and 2B, and had a magnetic path: length of 1.85 cm and an effective cross-sectional area of 0.07 $cm^2$. Ba ferrite was used as the permanent magnet 41, and the thickness was 1 mm.

Figure 5:
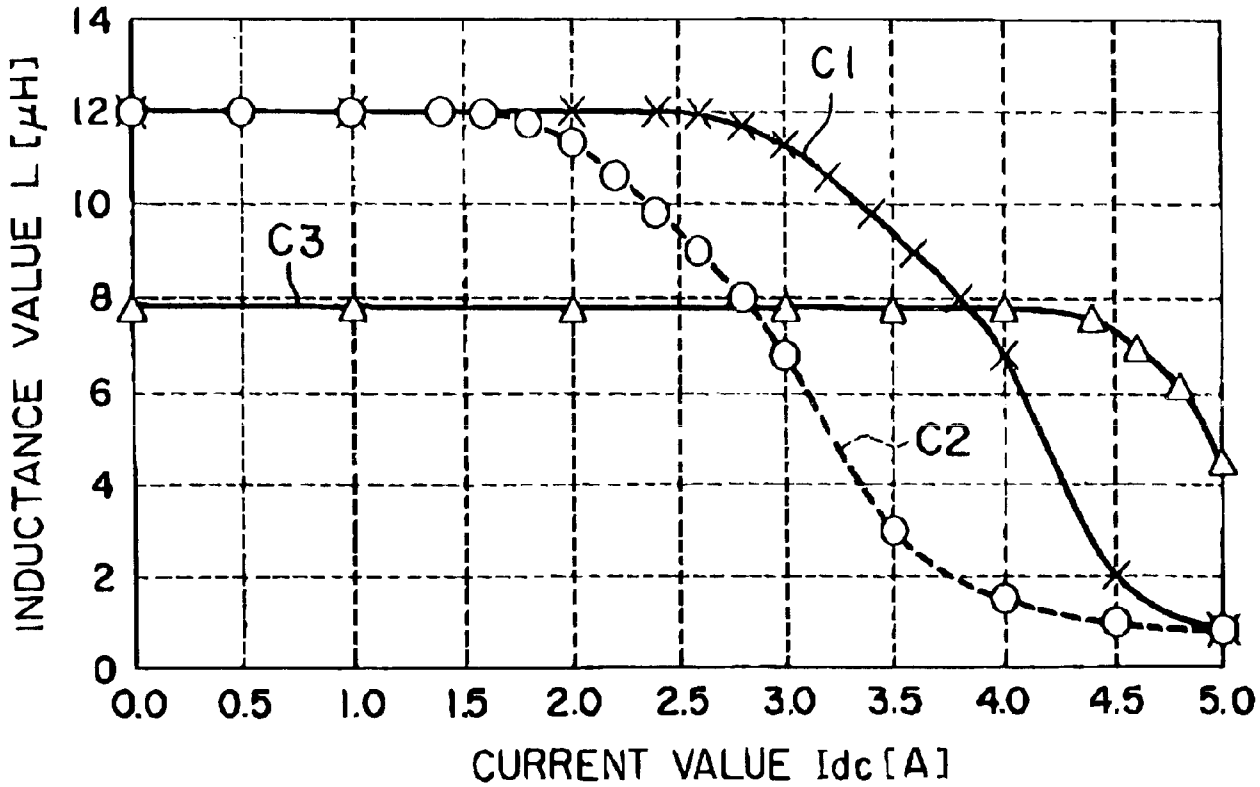
FIG. 5 is a drawing showing measurement results of direct-current superimposed inductance characteristics indicated by the relationship of the inductance relative to the current while the values in the embodiment of the inductor component shown in FIG. 4B according to Example 1 are contrasted with the values in the conventional inductor components shown in FIGS. 1A, 1B, 2A, and 2B.

Comparisons will be made among one embodiment of the inductor component according to Example 1 indicated by the curve C1, a conventional inductor component shown in FIGS. 1A and 1B indicated by the curve C2, and a conventional inductor component shown in FIGS. 2A and 2B indicated by the curve C3 with reference to FIG. 5. It is clear that regarding the embodiment of the inductor component according to Example 1, the direct-current super-imposed inductance characteristic is improved by 50% relative to the curve C2 using no magnetic bias, and the initial inductance value is not reduced due to reduction of the effective permeability in contrast to the curve C3 using a magnetic bias.

The results similar to these results are obtained in the case of each inductor component being applied to a transformer. Consequently, it is shown that not only the direct-current superimposed inductance characteristic is improved, but also the operating power Po can be increased substantially by enlargement of the magnetic flux density width ΔB'. Accompanying the enlargement of the magnetic flux density width ΔB', the number of turns of the coil 47 can be reduced and, in addition to this, reduction of loss and miniaturization can be achieved.

Figure 4C:
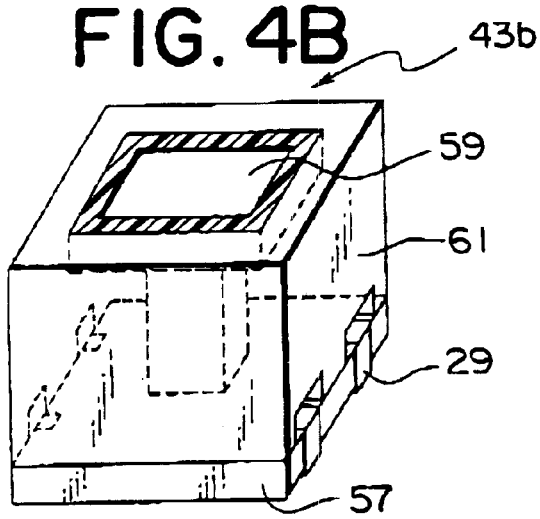
FIG. 4C is a perspective view of another embodiment of the inductor component shown in FIG. 4A.

In Example 1, although the description has been primarily made for one embodiment of the inductor component shown in FIG. 4B, these results are nearly equivalent to those obtained regarding the other embodiment of the inductor component shown in FIG. 4C.

EXAMPLE 2

Figure 6A:
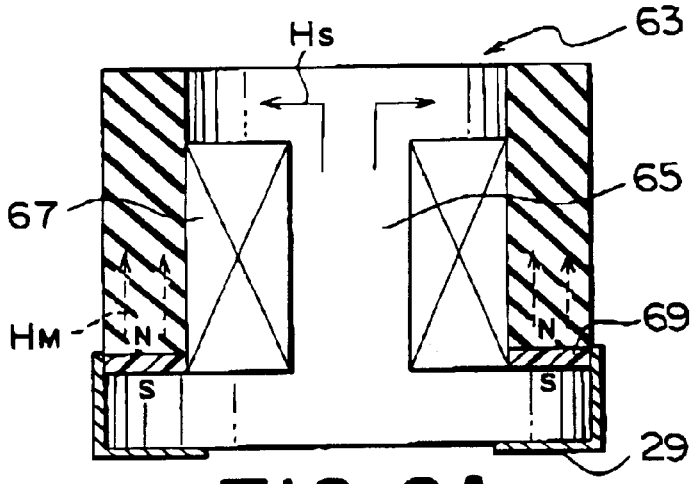
FIG. 6A is a sectional side view showing a basic configuration of an inductor component according to Example 2 of the present invention.

Regarding the basic configuration shown in FIG. 6A, an inductor component 63 according to Example 2 contains a drum magnetic core 65, a coil 67, and a sleeve core. The drum magnetic core 65 is made of a magnetic material having a structure including integrated flanges of different sizes at both ends of a columnar material. The coil 67 is wound around the columnar material in the drum magnetic core 65 and is placed between the flanges. The sleeve core is in contact with the outer edge of the major flange in the drum magnetic core 65 with the coil 67 wound around while a ring-shaped permanent magnet 69 intervenes, and is placed on the periphery of the minor flange and the coil 67. The permanent magnet 69 is placed in the gap in a closed magnetic circuit formed with the drum magnetic core 65 and the sleeve core, and on the periphery of the major flange (that is, placed by insertion into the gap between the outer edge of the major flange in the drum magnetic core 65 and the sleeve core) in order to apply a direct-current magnetic field $H_M$ in the direction opposite to the direction of a magnetic field $H_s$ (direction of the magnetic flux) generated by a magnetomotive force due to the coil 67. Furthermore, a terminal 29 is placed at a predetermined position in the neighborhood of the bottom portion of the major flange in order to connect with a lead wire of the end portion of the coil 67.

An embodiment of the inductor component will be described with reference to FIG. 6B. This inductor component is formed into the shape of a cylindrical column as a whole based on the basic configuration shown in FIG. 6A. That is, the columnar material in thee drum magnetic core 65 is a cylindrical column-shaped material, the major flange is a disk-shaped lower flange 71, and the minor flange is a disk-shaped upper flange 73. The permanent magnet 69*a* is in the shape of a ring, and the sleeve core is a cylindrical sleeve core 75.

Another embodiment of the inductor component will be described with reference to FIG. 6C. This inductor component is formed into the shape of a quadrangular prism as a whole based on the basic configuration shown in FIG. 6A. Consequently, the columnar material in the drum magnetic core 65 is a quadrangular prism-shaped material the major flange is a quadrangular plate-shaped lower flange 77, and the minor flange is a quadrangular plate-shaped upper flange 79. The permanent magnet 69*b* is in the shape of a quadrangular frame plate, and the sleeve core is a quadrangular tube-shaped sleeve core 81.

In either shape of inductor component, the drum magnetic core 65 is manufactured by performing the steps of pressing the Ni—Zn-based ferrite powder into the shape of a cylindrical column or quadrangular prism, calcining, cutting into the shape of a drum, and sintering. The steps of pressing into the shape of a cylindrical column or quadrangular prism and sintering may be performed in advance and, thereafter, cutting may be performed. However, in this case, although accuracy of dimension is increased, cost is increased disadvantageously. The cylindrical sleeve core 75 or quadrangular tube-shaped sleeve core 81 are manufactured using the Ni—Zn ferrite powder by performing the steps of pressing into the shape of a cylinder or quadrangular tube and sintering.

Figure 6B:
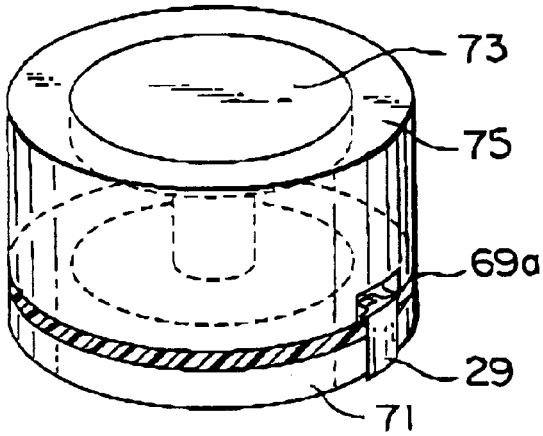
FIG. 6B is a perspective view of an embodiment of the inductor component shown in FIG. 6A.

In the embodiment shown in FIG. 6B, a rare-earth magnet powder was used for the permanent magnet 69*a*. The rare-earth magnet powder had a composition of $Sm(Co_{0.742}Fe_{0.20}Cu_{0.055}Zr_{0.029})_{7.7}$, an average particle diameter of 5 $\mu$m, a maximum particle diameter of 45 $\mu$m, an intrinsic coercive force $H_c$ of $15.8\times10^5$ (A/m) or more, and a Curie temperature $T_c$ of 770° C. The surface of the rare-earth magnet powder was coated with Zn, and as a binder, a poly(amide-imide) resin was mixed and molded at a volume ratio of 40%, so that the resistivity was made to be 0.5 Ωcm or more.

Regarding the configuration of the drum magnetic core 65 and the cylindrical sleeve core 75 used herein, for example, the magnetic path length is 1.85 cm, the effective cross-sectional area is 0.07 $cm^2$, and the gap is 150 $\mu$m. For example, the coil 67 is wound with 15 turns, the direct-current resistance is 20 mΩ, and the thickness of the permanent magnet 69*a* is 120 $\mu$m.

As comparative examples, prototype inductor components were. manufactured as well. In a manner similar to that described in Example 1, one inductor component had the configuration and specifications shown in FIGS. 1A and 1B, and the other inductor component had the configuration and specifications shown in FIGS. 2A and 2B.

Regarding each of these inductor components as well, the direct-current superimposed inductance characteristic was measured, and the results were nearly similar to those in the case shown in FIG. 6. Therefore, when the case of the embodiment of the inductor component according to Example 2 is compared to the conventional inductor components as comparative examples, the direct-current superimposed inductance characteristic is improved by about 50% relative to that of the inductor component using no magnetic bias, and the initial inductance value is not reduced due to reduction of the effective permeability in contrast to that of the inductor component using a magnetic bias.

The results similar to these results are obtained in the case of each inductor component being applied to a transformer. Consequently, it is shown that not only the direct-current superimposed inductance characteristic is improved, but also the operating power Po can be increased substantially by enlargement of the magnetic flux density width ΔB'. Accompanying the enlargement of the magnetic flux density width ΔB', the number of turns of the coil 67 can be reduced and, in addition to this, reduction of loss and miniaturization can be achieved.

Figure 6C:
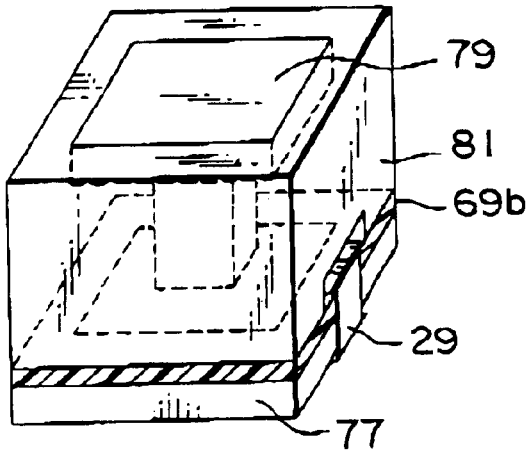
FIG. 6C is a perspective view of another embodiment of the inductor component shown in FIG. 6A.

In Example 2, although the description has been primarily made for one embodiment of the inductor component shown in FIG. 6B, these results are nearly equivalent to those obtained regarding the other embodiment of the inductor component shown in FIG. 6C.

EXAMPLE 3

Figure 7A:
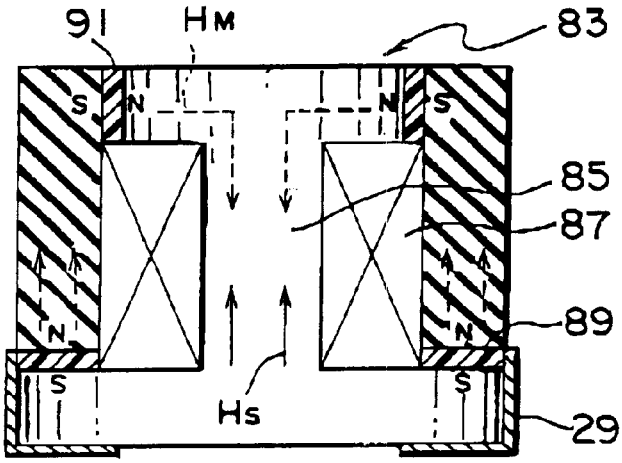
FIG. 7A is a sectional side view showing a basic configuration of an inductor component according to Example 3 of the present invention.

Regarding the basic configuration shown in FIG. 7A, an inductor component 83 according to Example 3 contains a drum magnetic core 85, a coil 87, a sleeve core, and permanent magnets 91 and 89.

The drum magnetic core 85 is made of a magnetic material having a structure including integrated flanges of different sizes at both ends of a columnar material. The coil 87 is wound around the columnar material in the drum magnetic core 85 and is placed between the flanges. The sleeve core is in contact with the outer edge of the major flange in the drum magnetic core 85 with the coil 87 wound around while a ring-shaped permanent magnet 89 intervenes, and is placed on the periphery of the minor flange and the coil 87. The permanent magnet 91 is placed in the gap in a closed magnetic circuit formed with the drum magnetic core 85 and the sleeve core, and on the periphery of the minor flange (that is, placed by insertion into the gap between the minor flange in the drum magnetic core 85 and the sleeve core) in order to apply a direct-current magnetic field $H_M$ in the direction opposite to the direction of a magnetic field $H_s$ generated by a magnetomotive force due to the coil 87. The permanent magnet 89 is placed on the periphery of the major flange (that is, placed by insertion into the gap between the outer edge of the major flange in the drum magnetic core 85 and the sleeve core) in order to apply a direct-current magnetic field $H_M$ in the direction opposite to the direction of a magnetic field $H_s$ generated by a magnetomotive force due to the coil 87. A terminal 29 is placed at a predetermined position in the neighborhood of the bottom portion of the major flange in order to connect with a lead wire of the end portion of the coil 87.

An embodiment of the inductor component will be described with reference to FIG. 7B. This inductor component is formed into the shape of a cylindrical column as a whole based on the basic configuration shown in FIG. 7A. That is, the columnar material in the drum magnetic core 85 is a cylindrical column-shaped material, the major flange is a disk-shaped lower flange 93, and the minor flange is a disk-shaped upper flange 95. The permanent magnet 91 is in the shape of a cylinder, the permanent magnet 89 is in the shape of a ring, and the sleeve core is a cylindrical sleeve core 97.

Another embodiment of the inductor component will be described with reference to FIG. 7C. This inductor component is formed into the shape of a quadrangular prism as a whole based on the basic configuration shown in FIG. 7A. That is, the columnar material in the drum magnetic core 85 is a quadrangular prism-shaped material. The major flange is a quadrangular plate-shaped lower flange 99. The minor flange is a quadrangular plate-shaped upper flange 101. The permanent magnet 91 is in the shape of a quadrangular tube. The permanent magnet 89 is in the shape of a quadrangular frame plate. The sleeve core is a quadrangular tube-shaped sleeve core 103.

In either shape of inductor component, the drum magnetic core 85 is manufactured by performing the steps of pressing the Ni—Zn-based ferrite powder into the shape of a cylindrical column or quadrangular prism, calcining, cutting into the shape of a drum, and sintering. The steps of pressing into the shape of a cylindrical column or quadrangular prism and sintering may be performed in advance and, thereafter, cutting may be performed. However, in this case, although accuracy of dimension is increased, cost is increased disadvantageously. The cylindrical sleeve core 97 and quadrangular tube-shaped sleeve core 103 are manufactured using the Ni—Zn ferrite powder by performing the steps of pressing into the shape of a cylinder or quadrangular tube and sintering.

Figure 7B:
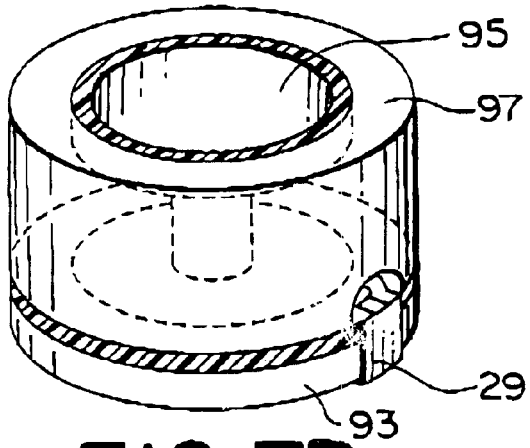
FIG. 7B is a perspective view of an embodiment of the inductor component shown in FIG. 7A.
Figure 7C:
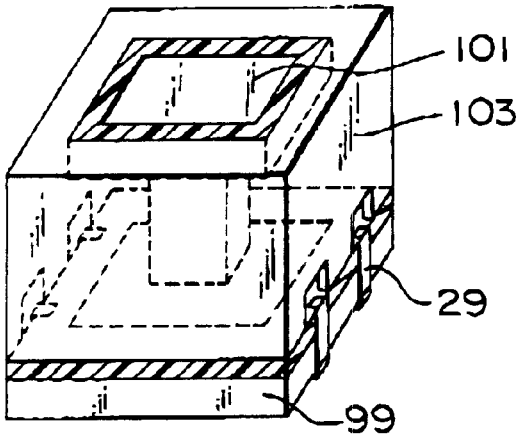
FIG. 7C is a perspective view of another embodiment of the inductor component shown in FIG. 7A.

In the embodiment shown in FIG. 7B, a rare-earth magnet powder was used for the permanent magnets 89 and 91. The rare-earth magnet powder had a composition of $Sm(Co_{0.742}Fe_{0.20}Cu_{0.055}Zr_{0.029})_{7.7}$, an average particle diameter of 5 μm, a maximum particle diameter of 45 μm, an intrinsic coercive force $H_c$ of $15.8\times10^5$ (A/m) or more, and a Curie temperature $T_c$ of 770° C. The surface of the rare-earth magnet powder was coated with Zn, and as a binder, a poly(amide-imide) resin was mixed and molded at a volume ratio of 40%, so that the resistivity was made to be 0.5 Ωcm or more.

Regarding the configuration of the drum magnetic core 85 and the cylindrical sleeve core 97 used herein, for example, the magnetic path length is 1.85 cm, the effective cross-sectional area is 0.07 $cm^2$, and the gap is 80 μm. For example, the coil 87 is wound with 15 turns, the direct-current resistance is 20 mΩ, and each of the thicknesses of the permanent magnets 89 and 91 is 70 μm.

As comparative examples, prototype inductor components were manufactured as well. One inductor component had the configuration shown in FIGS. 1A and 1B, and had a magnetic path length of 1.85 cm and an effective cross-sectional area of 0.07 $cm^2$. The thickness of an insulating material 25 was 80 μm. The other inductor component had the configuration shown in FIGS. 2A and 2B, and had a magnetic path length of 1.85 cm and an effective cross-sectional area of 0.07 $cm^2$. Ba ferrite was used as the permanent magnet 41, and the thickness was 1 mm.

Comparisons will be made among one embodiment of the inductor component according to Example 3 indicated by the curve C4, the conventional inductor component shown in FIGS. 1A and 1B indicated by the curve C5, and the conventional inductor component shown in FIGS. 2A and 2B indicated by the curve C6 with reference to FIG. 8. It is clear that regarding the one embodiment of the inductor component according to Example 3, the direct-current superimposed inductance characteristic is improved by 50% relative to the curve C5 using no magnetic bias, and the initial inductance value is not reduced due to reduction of the effective permeability in contrast to the curve C6 using a magnetic bias.

The results similar to these results are obtained in the case of each inductor component being applied to a transformer. Consequently, it is shown that not only the direct-current superimposed inductance characteristic is improved, but also the operating power Po can be increased substantially by enlargement of the magnetic flux density width ΔB'. Accompanying the enlargement of the magnetic flux density width ΔB', the number of turns of the coil 87 can be reduced and, in addition to this, reduction of loss and miniaturization can be achieved.

In Example 3, although the description has been primarily made for the one embodiment of the inductor component shown in FIG. 7B, these results are nearly equivalent to those obtained regarding the other embodiment of the inductor component shown in FIG. 7.

EXAMPLE 4

Figure 9A:
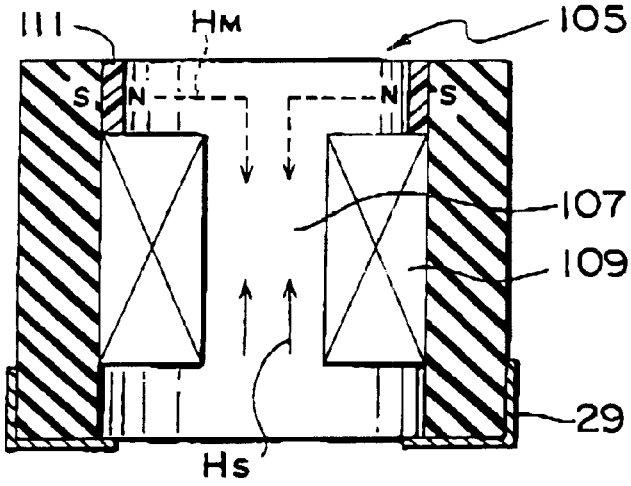
FIG. 9A is a sectional side view showing a basic configuration of an inductor component according to Example 4 of the present invention.

Regarding the basic configuration shown in FIG. 9A, an inductor component 105 according to Example 4 contains a drum magnetic core 107, a coil 109, a sleeve core, and a permanent magnet 111.

The drum magnetic core 107 is made of a magnetic material having a structure including integrated flanges of slightly different sizes at both ends of a columnar material.

The coil 109 is wound around the columnar material in the drum magnetic core 107 and is placed between the flanges.

The sleeve core is in contact with the side surface of the major flange in the drum magnetic core 107 with the coil 109 wound around, and is placed to cover the periphery of each flange and the coil 109.

The permanent magnet 111 is placed in the gap in a closed magnetic circuit formed with the drum magnetic core 107 and the sleeve core, and on the periphery of the minor flange (that is, placed by insertion into the gap between the minor flange in the drum magnetic core 107 and the sleeve core) in order to apply a direct-current magnetic field $H_M$ in the direction opposite to the direction of a magnetic field $H_s$ generated by a magnetomotive force due to the coil 109.

A terminal 29 is placed at a predetermined position in the neighborhood of the bottom portion of the sleeve core in order to connect with a lead wire of the end portion of the coil 109.

An embodiment of the inductor component will be described with reference to FIG. 9B. This inductor component is formed into the shape of a cylindrical column as a whole based on the basic configuration shown in FIG. 9A. That is, the columnar material in the drum magnetic core 107 is a cylindrical column-shaped material, the major flange is a disk-shaped lower flange 113, and the minor flange is a disk-shaped upper flange 115. The permanent magnet 111 is in the shape of a cylinder, and the sleeve core is a cylindrical sleeve core 114.

Another embodiment of the inductor component will be described with reference to FIG. 9C. This inductor component is formed into the shape of a quadrangular prism as a whole based on the basic configuration shown in FIG. 9A. That is, the columnar material in the drum magnetic core 107 is a quadrangular prism-shaped material, the major flange is a quadrangular plate-shaped lower flange 117, and the minor flange is a quadrangular plate-shaped upper flange 119. The permanent magnet 111 is in the shape of a quadrangular tube, and the sleeve core is a quadrangular tube-shaped sleeve core 121.

In either shape of inductor component, the drum magnetic core 107 is manufactured by performing the steps of pressing the Ni—Zn-based ferrite powder into the shape of a cylindrical column or quadrangular prism, calcining, cutting into the shape of a drum, and sintering. The steps of pressing into the shape of a cylindrical column or quadrangular prism and sintering may be performed in advance and, thereafter, cutting may be performed. However, in this case, although accuracy of dimension is increased, cost is increased disadvantageously. The cylindrical sleeve core 114 and quadrangular tube shaped sleeve core 121 are manufactured using the Ni—Zn ferrite powder by performing the steps of pressing into the shape of a cylinder or quadrangular tube and sintering.

Figure 9B:
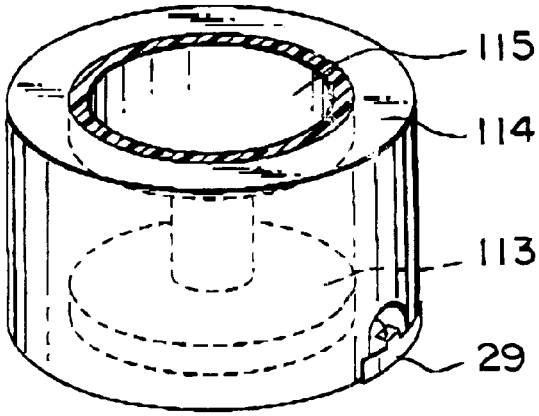
FIG. 9B is a perspective view of an embodiment of the inductor component shown in FIG. 9A.

In the embodiment shown in FIG. 9B, a rare-earth magnet powder was used for the permanent magnet 111. The rare-earth magnet powder had a composition of $Sm(Co_{0.742}Fe_{0.20}Cu_{0.055}Zr_{0.029})_{7.7}$, an average particle diameter of 5 μm, a maximum particle diameter of 45 μm, an intrinsic coercive force $H_c$ of $15.8\times10^5$ (A/m) or more, and a Curie temperature $T_c$ of 770° C. The surface of the rare-earth magnet powder was coated with Zn, and as a binder, a poly(amide-imide) resin was mixed and molded at a volume ratio of 40%, so that the resistivity was made to be 0.65 cm or more.

Regarding the configuration of the drum magnetic core 107 and the cylindrical sleeve core 114 used herein, for example, the magnetic path length is 1.85 cm, the effective cross-sectional area is 0.07 $cm^2$, and the gap is 150 μm. For example, the coil 109 is wound with 15 turns, the direct-current resistance is 20 mΩ, and the thickness of the permanent magnet 111 is 120 μm.

As comparative examples, prototype inductor components were manufactured as well. One inductor component had the configuration shown in FIGS. 1A and 1B, and had a magnetic path length of 1.85 cm and an effective cross-sectional area of 0.07 $cm^2$. The thickness of an insulating material 25 was 75 μm. The other inductor component had the configuration shown in FIGS. 2A and 2B, and had a magnetic path length of 1.85 cm and an effective cross-sectional area of 0.07 $cm^2$. Ba ferrite was used as the permanent magnet 41, and the thickness was 1 mm.

Figure 8:
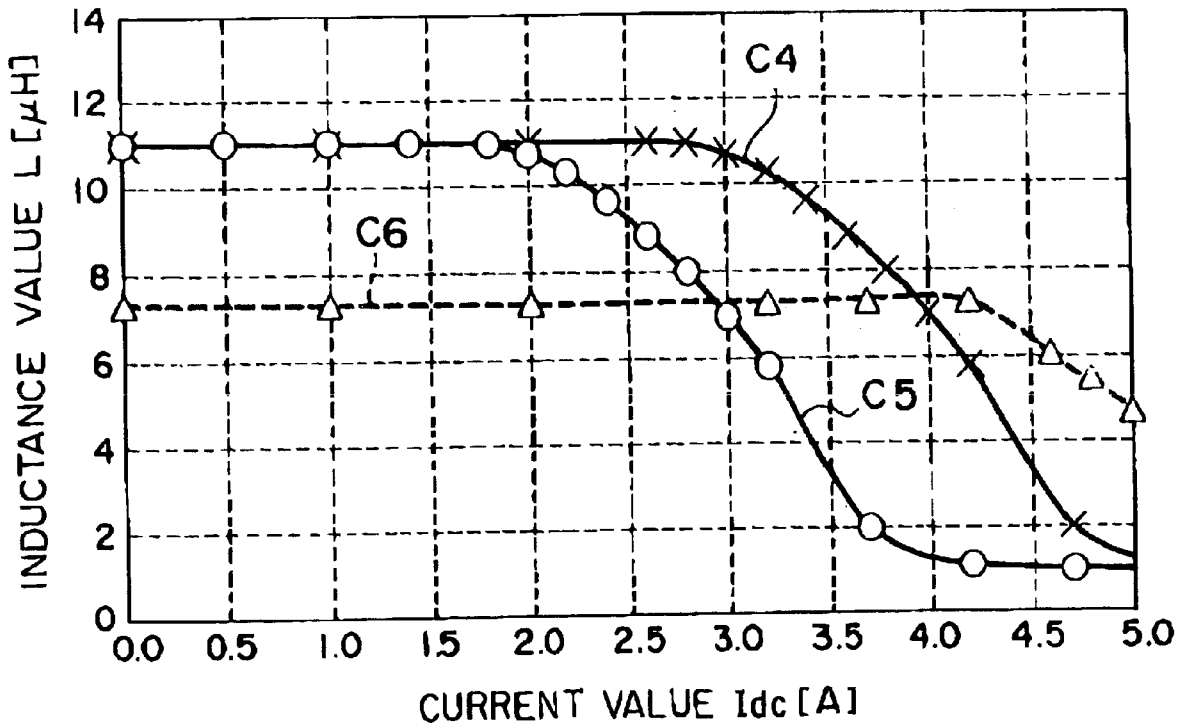
FIG. 8 is a drawing showing measurement results of direct-current superimposed inductance characteristics indicated by the relationship of the inductance relative to the current while the values in the embodiment of the inductor component shown in FIG. 7B according to Example 3 are contrasted with the values in the conventional inductor components shown in FIGS. 1A, 1B, 2A, and 2B.

Regarding each of these inductor components as well, the direct-current superimposed inductance characteristic was measured, and the results were nearly similar to those in the case shown in FIG. 8. Therefore, when the case of the embodiment of the inductor component according to Example 4 is compared to the conventional inductor components as comparative examples, the direct-current superimposed inductance characteristic is improved by about 50% relative to that of the inductor component using no magnetic bias, and the initial inductance value is not reduced due to reduction of the effective permeability in contrast to that of the inductor component using a magnetic bias.

The results similar to these results are obtained in the case of each inductor component being applied to a transformer. Consequently, it is shown that not only the direct-current superimposed inductance characteristic is improved, but also the operating power Po can be increased substantially by enlargement of the magnetic flux density width ΔB'. Accompanying the enlargement of the magnetic flux density width ΔB', the number of turns of the coil 109 can be reduced and, in addition to this, reduction of loss and miniaturization can be achieved.

Figure 9C:
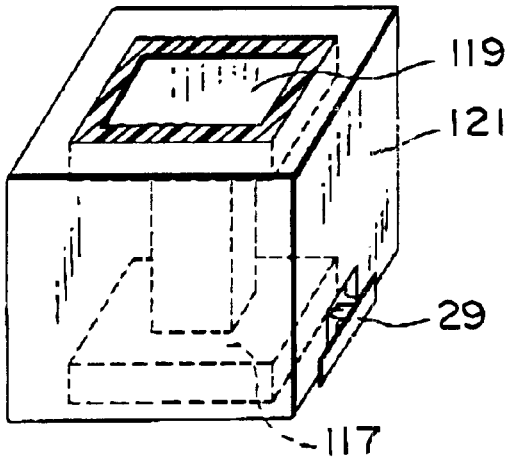
FIG. 9C is a perspective view of another embodiment of the inductor component shown in FIG. 9A.

In Example 4, although the description has been primarily made for one embodiment of the inductor component shown in FIG. 9B, these results are nearly equivalent to those obtained regarding the other embodiment of the inductor component shown in FIG. 9C.

EXAMPLE 5

Figure 10A:
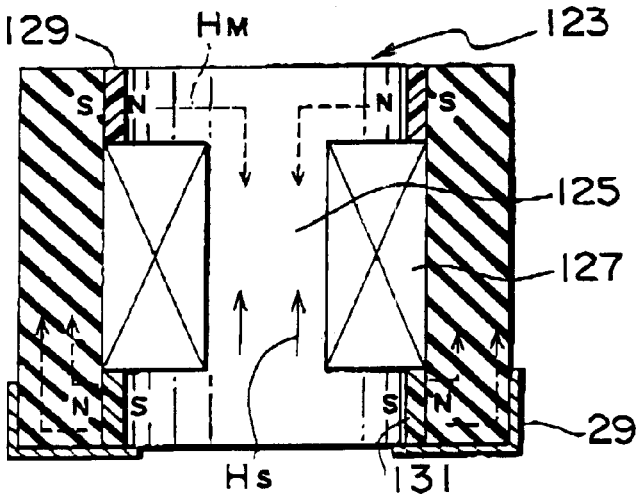
FIG. 10A is a sectional side view showing a basic configuration of an inductor component according to Example 5 of the present invention.

Regarding the basic configuration shown in FIG. 10A, an inductor component 123 according to Example 5 contains a drum magnetic core 125, a coil 127, a sleeve core, and a permanent magnets 129 and 131. The drum magnetic core 125 is made of a magnetic material having a structure including integrated flanges of the same size at both ends of a columnar material. The coil 127 is wound around the columnar material in the drum magnetic core 125 and is placed between the flanges. The sleeve core is placed in the neighborhood of the side surfaces of both flanges in the drum magnetic core 125 with the coil 127 wound around to cover the periphery of each flange and the coil 127. The permanent magnets 129 and 131 are placed in the gaps in a closed magnetic circuit formed with the drum magnetic core 125 and the sleeve core, and on the periphery of both flanges (that is, placed by insertion into each of the gaps between both flanges in be drum magnetic core 125 and the sleeve core) in order to apply a direct-current magnetic field $H_M$ in the direction opposite to the direction of a magnetic field $H_s$ generated by a magnetomotive force due to the coil 127. A terminal 29 is placed at a predetermined position in the neighborhood of the bottom portion of the sleeve core in order to connect with a lead wire of the end portion of the coil 127.

An embodiment of the inductor component will be described with reference to FIG. 10B. This inductor component is formed into the shape of a cylindrical column as a whole based on the basic configuration shown in FIG. 10A. That is, the columnar material in the drum magnetic core 125 is a cylindrical column-shaped material, one flange is a disk-shaped lower flange 133, and the other flange is a disk-shaped upper flange 135. Each of the permanent magnet 129 and 131 is in the shape of a cylinder, and the sleeve core is a cylindrical sleeve core 137.

Another embodiment of the inductor component will be described with reference to FIG. 10C. This inductor component is formed into the shape of a quadrangular prism as a whole based on the basic configuration shown in FIG. 10A. That is, the columnar material in the drum magnetic core 125 is a quadrangular prism-shaped material, one flange is a quadrangular plate-shaped lower flange 139, and the other flange is a quadrangular plate-shaped upper flange 141. Each of the permanent magnet 129 and 131 is in the shape of a quadrangular tube, and the sleeve core is a quadrangular tube-shaped sleeve core 143.

In either shape of inductor component, the drum magnetic core 125 is manufactured by performing the steps of pressing the Ni—Zn-based ferrite powder into the shape of a cylindrical column or quadrangular prism, calcining, cutting into the shape of a drum, and sintering. The steps of pressing into the shape of a cylindrical column or quadrangular prism and sintering may be performed in advance and, thereafter, cutting may be performed. However, in this case, although accuracy of dimension is increased, cost is increased disadvantageously. The cylindrical sleeve core 139 and quadrangular tube-shaped sleeve core 143 are manufactured using the Ni—Zn ferrite powder by performing the steps of pressing into the shape of a cylinder or quadrangular tube and sintering.

Figure 10B:
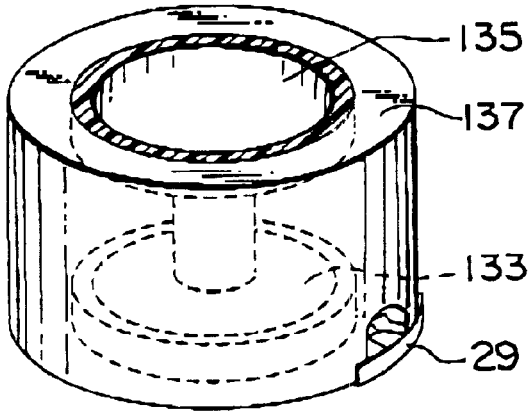
FIG. 10B is a perspective view of an embodiment of the inductor component shown in FIG. 10A.

In the embodiment shown in FIG. 10B, a rare-earth magnet powder was used for the permanent magnets 129 and 131. The rare-earth magnet powder had a composition of $Sm(Co_{0.742}Fe_{0.20}Cu_{0.055}Zr_{0.029})_{7.7}$, an average particle diameter of 5 $\mu$m, a maximum particle diameter of 45 $\mu$m, an intrinsic coercive force $H_c$ of $15.8\times10^5$ (A/m) or more, and a Curie temperature $T_c$ of 770° C. The surface of the rare-earth magnet powder was coated with Zn, and as a binder, a poly(amide-imide) resin was mixed and molded at a volume ratio of 40%, so that the resistivity was made to be 0.5 Ωcm or more.

Regarding the configuration of the drum magnetic core 125 and the cylindrical sleeve core 137 used herein, for example, the magnetic path length is 1.85 cm, the effective cross-sectional area is 0.07 $cm^2$, and the gap is 80 $\mu$m. For example, the coil 127 is wound with 15 turns, the direct-current resistance is 20 mΩ, and each of the thicknesses of the permanent magnets 129 and 131 is 70 $\mu$m.

As comparative examples, prototype inductor components were manufactured as well. One inductor component had the configuration shown in FIGS. 1A and 1B. and had a magnetic path length of 1.85 cm and an effective cross-sectional area of 0.07 $cm^2$. The thickness of an insulating material 25 was 80 $\mu$m. The other inductor component had the configuration shown in FIGS. 2A and 2B, and had a magnetic path length of 1.85 cm and an effective cross-sectional area of 0.07 $cm^2$. Ba ferrite was used as the permanent magnet 41, and the thickness was 1 mm.

Regarding each of these inductor components as well, the direct-current superimposed inductance characteristic was measured, and the results were nearly similar to those in the case shown in FIG. 8. Therefore, when the case of the embodiment of the inductor component according to Example 5 is compared to the conventional inductor components as comparative examples, the direct-current superimposed inductance characteristic is improved by about 50% relative to that of the inductor component using no magnetic bias, and the initial inductance value is not reduced due to reduction of the effective permeability in contrast to that of the inductor component using a magnetic bias.

The results similar to these results are obtained in the case of each inductor component being applied to a transformer. Consequently, it is shown that not only the direct-current superimposed inductance characteristic is improved, but also the operating power Po can be increased substantially by enlargement of the magnetic flux density width ΔB'. Accompanying the enlargement of the magnetic flux density width ΔB', the number of turns of the coil 127 can be reduced and, in addition to this, reduction of loss and miniaturization can be achieved.

Figure 10C:
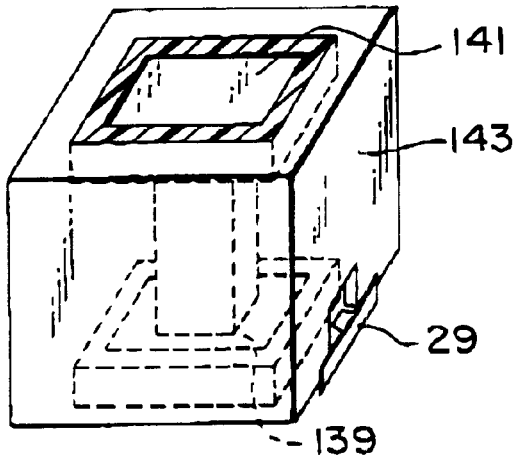
FIG. 10C is a perspective view of another embodiment of the inductor component shown in FIG. 10A.

In Example 5, although the description has been primarily made for one embodiment of the inductor component shown in FIG. 10B, these results are nearly equivalent to those obtained regarding the other embodiment of the inductor component shown in FIG. 10C.

Some Examples will be described below in relation to the magnetic characteristics of the permanent magnet 49 for applying a magnetic bias used for the inductor component according to the aforementioned Example 1.

EXAMPLE 6

Regarding the conventional technique, the problem of thermal demagnetization has been pointed out. In Example 6, a measure has been taken for preventing occurrence of thermal demagnetization by the use of the Sm—Co-based rare-earth magnet powder having a high Curie temperature $T_c$ as the powder for permanent magnet in order to impart durability against heat during the step of reflow soldering.

An inductor component having the configuration used in Example 1 was equipped with the permanent magnet 49 having a Curie temperature of 770° C. Another inductor component having the configuration shown in FIGS. 1A and 1B was equipped with the conventional permanent magnet 41 having a low Curie temperature of 450° C. made of Ba ferrite. Each inductor component was held under the condition of the reflow furnace, at 270° C. for 1 hour, in a thermostatic bath, and was cooled to room temperature. Subsequently, the direct-current superimposed inductance characteristic was measured. The results thereof are shown in Table 1.

TABLE 1

| | L before reflowing (at 3A) | L after reflowing (at 3A) |
|---|---|---|
| Example 1 (Tc 770° C.) | 11.5(μH) | 11.4(μH) |
| Ba ferrite magnet (Tc 450° C.) | 11.5(μH) | 7.0(μH) |

As is clear from Table 1, regarding the inductor component equipped with the permanent magnet 49 using the SmCo-based rare-earth magnet powder having a high Curie temperature $T_c$ of 770° C. according to Example 1, no change is observed between the direct-current superimposed inductance characteristics before and after the reflow. On the other hand, regarding the conventional inductor component equipped with the Ba ferrite magnet having a low Curie temperature of 450° C., irreversible demagnetization occurs due to heat, and degradation of the direct-current superimposed inductance characteristic occurs. Therefore, a rare-earth magnet powder having a Curie temperature $T_c$ of 500° C. or more must be used for the permanent magnet 49 in order to impart durability against heating, etc., due to the step of reflow soldering. In addition, demagnetization due to heat can be further hindered by using a rare-earth magnet powder having a composition of $Sm(Co_{bal}.Fe_{0.15}$ to 0.25 $Cu_{0.05}$ to $_{0.06}Zr_{0.02}$ to $_{0.03})_{7.0}$ to $_{8.5}$, a so-called third-generation $Sm_2Co_{17}$ magnet, among the SmCo-based magnetic powders.

Inductor components having the configuration used in Example 1 were prepared. One inductor component was equipped with the permanent magnet 49 having a composition of $Sm(Co_{0.742}Fe_{0.20}Cu_{0.055}Zr_{0.029})_{7.7}$, a so-called third-generation $Sm_2Co_{17}$ magnet. The other inductor component was equipped with the permanent magnet 49 having a composition of $Sm(Co_{0.78}Fe_{0.11}Cu_{0.10}Zr_{0.01})_{7.7}$. Each inductor component was held under the condition of the reflow furnace, at 270° C. for 1 hour, in a thermostatic bath, and was cooled to room temperature. Subsequently, the direct-current superimposed inductance characteristic was measured. The results thereof are shown in Table 2.

TABLE 2

| | L before reflowing (at 3A) | L after reflowing (at 3A) |
|---|---|---|
| Example 1 $Sm(Co_{0.742}Fe_{0.20}Cu_{0.055}Zr_{0.029})_{7.7}$ | 11.5(μH) | 11.4(μH) |
| magnet of Example 1 $Sm(Co_{0.78}Fe_{0.11}Cu_{0.10}Zr_{0.01})_{7.7}$ | 11.2(μH) | 7.0(μH) |

As is clear from Table 2, regarding the inductor component equipped with the permanent magnet 49 having a composition of $Sm(Co_{bal}.Fe_{0.15}$ to $_{0.25}Cu_{0.05}$ to $_{0.06}Zr_{0.02}$ to $_{0.03})_{7.0}$ to $_{8.5}$, no change is observed between the direct-current superimposed inductance characteristics before and after the reflow. On the other hand, regarding the inductor component equipped with the permanent magnet 49 having a composition of $Sm(Co_{0.78}Fe_{0.11}Cu_{0.10}Zr_{0.01})_{7.7}$, degradation of the direct-current superimposed inductance characteristic occurs. Therefore, a rare-earth magnet powder having a third-generation composition of $Sm(Co_{bal}.Fe_{0.15}$ to 0.25 $Cu_{0.05}$ to $_{0.06}Zr_{0.02}$ to $_{0.03})_{7.0}$ to $_{8.5}$ must be used for the permanent magnet 49 in order to impart durability against heating, etc., due to the step of reflow soldering.

EXAMPLE 7

Regarding the conventional technique, the problem has been pointed out in that demagnetization has occurred due to an excessive current. In Example 7, the Sm—Co-based rare-earth magnet powder having a high intrinsic coercive force $H_c$ ($iH_c$) is used in order that the coercive force of the permanent magnet may not be destroyed due to the direct-current magnetic field accompanying the excessive current.

An inductor component having the configuration used in Example 1 was equipped with the permanent magnet 49 having an intrinsic coercive force $H_c$ of $15.8\times10^5$ (A/m). Another inductor component having the configuration shown in FIGS. 1A and 1B was equipped with the conventional permanent magnet 41 having an intrinsic coercive force $H_c$ of $1.58\times10^5$ (A/m). This intrinsic coercive force was one-tenth that of the permanent magnet 49. Each inductor component was applied with an excessive current of 300A·50 μs. Subsequently, the direct-current superimposed inductance characteristic was measured. The results thereof are shown in Table 3.

TABLE 3

| | L before application of electric current (at 3A) | L after application of electric current (at 3A) |
|---|---|---|
| Example 1 (coercive force 20 kOe) | 11.5(μH) | 11.4(μH) |
| Ba ferrite magnet (coercive force 2 kOe) | 11.5(μH) | 8.0(μH) |

As is clear from Table 3, regarding the inductor component equipped with the permanent magnet 49 having a high intrinsic coercive force $H_c$ according to Example 1, no change is observed between the direct-current superimposed inductance characteristics before and after application of the excessive current. On the other hand, regarding the conventional inductor component equipped with the permanent magnet 41 having an intrinsic coercive force of one-tenth that of the permanent magnet 49, demagnetization occurs due to a magnetic field applied to the permanent magnet 41 in the opposite direction, and degradation occurs in the direct-current superimposed inductance characteristic. Therefore, a rare-earth magnet powder having an intrinsic coercive force $H_c$ of $7.9\times10^5$ (A/m) or more must be used for the permanent magnet 49 in order to impart durability against the direct-current magnetic field due to an excessive current.

EXAMPLE 8

Regarding the conventional technique, the problem has been pointed out in that demagnetization of the permanent magnet has occurred due to proceeding of oxidation with time. In Example 8, the magnet powder is coated With a metal or an alloy in order that oxidation may not occur.

Regarding inductor components having the configuration used in Example 1, an inductor component was equipped with the permanent magnet 49 coated with Zn, and another inductor component was equipped with the permanent magnet not coated with Zn. Each inductor component was immersed in salt water and, thereafter, was left in the atmosphere for 200 hours. Subsequently, the direct-current superimposed inductance characteristic was measured. The results thereof are shown in Table 4.

TABLE 4

| | L before left in the atmosphere (at 3A) | L after left in the atmosphere (at 3A) |
|---|---|---|
| Example 1 (with Zn coating) | 11.5(μH) | 11.4(μH) |
| magnet powder of Example 1 (without Zn coating) | 11.5(μH) | 10.3(μH) |

As is clear from Table 4, regarding the inductor component equipped with the permanent magnet 49 coated with Zn according to Example 1, no change is observed between the direct-current superimposed inductance characteristics before and after PCT. On the other hand, regarding the conventional inductor component equipped with the permanent magnet not coated with Zn, demagnetization occurs due to proceeding of oxidation with time and, therefore, degradation occurs in the direct-current superimposed inductance characteristic. Therefore, a rare-earth magnet powder of the permanent magnet 49 must be coated with a metal or an alloy in order to hinder the demagnetization due to proceeding of oxidation. Furthermore, the rare-earth magnet powder may be coated with inorganic glass, or the metal or alloy may be coated with nonmetallic inorganic compound. In addition, when an average powder particle diameter of the rare-earth magnet powder is specified to be 2.5 to 25 μm, and a maximum particle diameter is specified to be 50 μm or less, oxidation can be hindered during the manufacturing step as well.

Accordingly, regarding inductor components having the configuration used in Example 1, an inductor component was equipped with the permanent magnet 49 using a rare-earth magnet powder having an average particle diameter of 5 μm, and a maximum particle diameter of 45 μm, and another inductor component was equipped with the permanent magnet using a rare-earth magnet powder having an average particle diameter of 2 μm. Regarding each of the inductor components, the direct-current superimposed inductance characteristic was measured. The results thereof are shown in Table 5.

TABLE 5

| | Inductance Value (at 3A) |
|---|---|
| Example 1 average particle diameter 5 μm maximum particle diameter 45 μm | 11.5(μH) |
| magnet powder average particle diameter 2 μm maximum particle diameter 45 μm | 8.35(μH) |

As is clear from Table 5, regarding the inductor component equipped with the permanent magnet 49 using the rare-earth magnet powder having the average particle diameter of 5 μm, and the maximum particle diameter of 45 μm, the direct-current superimposed inductance characteristic (inductance value) is improved by 50% due to the magnetic bias. On the other hand, it is clear that regarding the inductor component equipped with the permanent magnet 49 using the rare-earth magnet powder having the average particle diameter of 2 μm, the direct-current superimposed inductance characteristic is improved by only 15%. Therefore, regarding the rare-earth magnet powder used for the permanent magnet 49, an average powder particle diameter must be 2.5 to 25 μm, and a maximum particle diameter must be 50 μm or less in order to hinder oxidation during the manufacturing step.

EXAMPLE 9

Regarding the conventional technique, the problem has been pointed out in that increase in core loss has occurred due to the low resistivity of the permanent magnet. In Example 9 the addition amount of the resin is specified to be 30% or more on a volume ratio basis in order to overcome the aforementioned problem and, therefore, to increase the resistivity.

Regarding inductor components having the configuration used in Example 1, an inductor component was equipped with the permanent magnet 49 having a resin content of 40% by volume relative to the rare-earth magnet powder and having a resistivity of 0.5 Ωcm, another inductor component was equipped with the permanent magnet 49 having a resin content of 20% by volume and a resistivity of 0.05 Ωcm, and another inductor component was equipped with the permanent magnet 49 having a resin content of 30% by volume and a resistivity of 0.1 Ωcm. Regarding each of the inductor components, the core loss was measured. The results thereof are shown in Table 6.

TABLE 6

| | specific resistivity (Ω · cm) | core loss (kW/m$^3$) at 300 kHz, 100 mT |
|---|---|---|
| Example 1 (resin content 40 vol %) | 0.5 | 515 |
| magnet powder used in Example 1 (resin content 20 vol %) | 0.05 | 1230 |
| magnet powder used in Example 1 (resin content 30 vol %) | 0.1 | 530 |

As is clear from Table 6, regarding the inductor component having the resin content of 20% by volume and the resistivity of 0.05 Ωcm, the core loss is deteriorated because an eddy current passes compared to the core loss of the inductor component having the resin content of 30% by volume or more. The inductor component having the resin content of 30% by volume and the resistivity of 0.1 Ωcm exhibits a core loss equivalent to that of the inductor component having the resin content of 40% by volume and the resistivity of 0.5 Ωcm. Therefore, the resin content must be 30% by volume or more relative to the rare-earth magnet powder used for the permanent magnet 49, and the resistivity must be 0.1 Ωcm or more in order to hinder increase in core loss accompanying reduction in the resistivity of the permanent magnet 49.

In the aforementioned Examples 6 to 9, although the description has been made for the supplementary items relating to the magnetic characteristics of the permanent magnet 49 for applying a magnetic bias used for the inductor component according to Example 1, these supplementary items are applied to the permanent magnets (permanent magnets 69, 89, 91, 111, 129, and 131) for applying a magnetic bias used for the inductor components according to each of the other Examples (Examples 2 to 5) in a manner similar to those in Examples 6 to 9.

As described above, regarding the inductor components according to the aforementioned Examples 1 to 9, the configuration includes concurrently the permanent magnet for applying a magnetic bias and the sleeve core having been used in different types of conventional products and furthermore, the permanent magnet is placed in at least one gap in a closed magnetic circuit formed with the drum magnetic core and the sleeve core in order to apply a direct-current magnetic field in the direction opposite to the direction of a magnetic field generated by a magnetomotive force due to the coil. Consequently, a usable magnetic flux density width is enlarged. In addition, a rare-earth magnet powder having superior magnetic characteristics is used for the permanent magnet, is mixed with a proper amount of resin, is adjusted to have a proper particle diameter, is coated with a metal or an alloy and, therefore, the resistivity can be specified to be a predetermined value or more. Furthermore, since the rare-earth magnet powder is coated with inorganic glass, and the metal or alloy is coated with a nonmetallic inorganic compound, the inductor component manufactured can treat a large current, has magnetic characteristics unlikely to be degraded, and is suitable for taking measures for magnetic shielding, miniaturization, and weight reduction with ease.

According to the present invention, miniaturization and reduction of loss can be achieved with respect to the transformer and choke coil for a switching power supply using the inductor component. Furthermore, the present invention can contribute substantially to, for example, miniaturization and increase of efficiency in the power circuit itself using the inductor component, and, therefore, is industrially useful by a large degree.

EXAMPLE 10

Figure 11A:
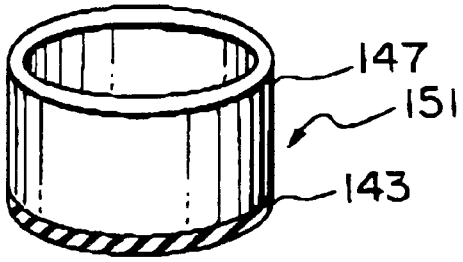
FIG. 11A is a perspective view showing a shape of a sleeve-shaped magnetic core of an inductor component according to Example 10 of the present invention.
Figure 11B:
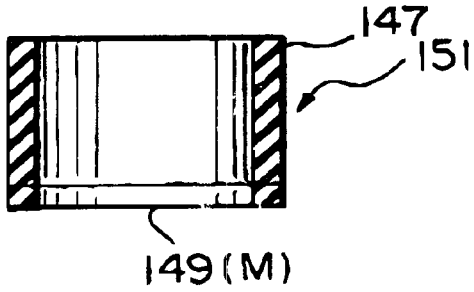
FIG. 11B is a sectional view of the magnetic core shown in FIG. 11A.

As shown in FIGS. 11A and 11B a mixture (viscous material) of a magnetic powder and an adhesive is coated (adhered) and dried on the periphery collar joint (fitting) surface of a sleeve-shaped magnetic core portion 147. Subsequently, a permanent magnet portion (M) 149 (a mixture magnet of the magnetic powder and the adhesive) is magnetized together with the magnetic core 147 portion, and is fixed so as to form a magnetic core 151.

Figure 11C:
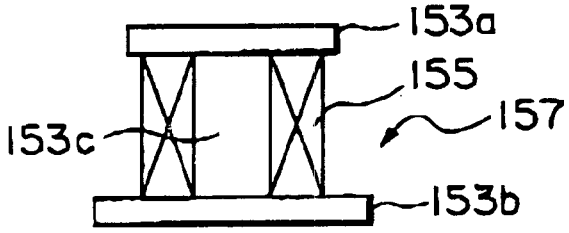
FIG. 11C is aside view showing a shape of a drum magnetic core to be fitted to the sleeve-shaped magnetic core of the inductor component shown in FIG. 11A.
Figure 11D:
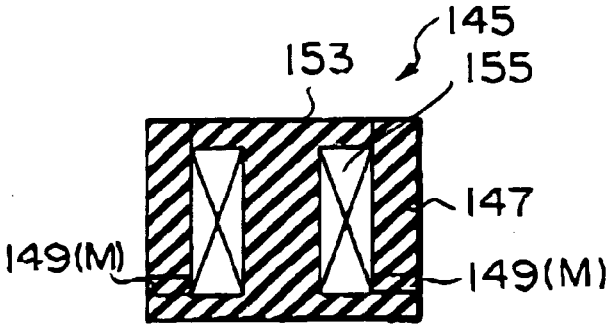
FIG. 11D is a sectional view of the inductor component according to Example 10 of the present invention.

As shown in FIG. 11C, a coil 155 is wound around a bobbin 153 made of a drum magnetic core and, therefore, a coil portion 157 is formed in advance. The coil portion 157 is covered with the magnetic core 151 so as to form an inductor component 145 composed of a transformer as shown in FIG. 11D.

Herein, Mn—Zn-based ferrite can be used as a material for the magnetic core portion 147 and the bobbin 157. However, any materials can be used as long as the material is a soft magnetic material.

The permanent magnet portion (M) 149 is composed of a bonded magnet formed from the viscous material made by mixing the magnetic powder and the resin. Any magnetic powder and any resin can be used for this bonded magnet as long as the resistivity is 0.1 Ω.

Any magnetic powder can be used as this magnetic powder as long as the magnetic powder has an intrinsic coercive force of 10 KOe (790 kA/m) or more, a Curie temperature ($T_c$) of 500° C. or more, and an average particle diameter of 2.5 to 5.0 μm.

Preferably, the magnetic powder is coated with 0.1 to 10% on a volume ratio basis of one metal selected from the group consisting of Zn, Al, Bi, Ga, In, Mg, Pb, Sb, and Sn or an alloy, or a complex is formed.

Preferably, the magnetic powder is blended with a silane coupling agent or a titanium coupling agent, and is subjected to a surface treatment before the magnetic powder is mixed with the resin.

Resins usable for binding the magnetic powder include one selected from the group consisting of polyimide resins, poly(amide-imide) resins, epoxy resins, poly(phenylene sulfide) resins, silicone resins, polyester resins, aromatic nylons, and liquid crystal polymer resins or a complex of these resins.

Next, a specific example of manufacture of the inductor component according to Example 10 of the present invention will be described.

A rare-earth magnet powder was prepared as the magnetic powder, and was coated with 1% of Zn on a volume ratio basis. The rare-earth magnet powder had an intrinsic coercive force of 15 KOe (1185 kA/m), a Curie temperature ($T_c$) of 770° C., an average particle diameter of 10 μm, and a composition represented by the general formula $Sm(Co_{bal}.Fe_{0.15\ to\ 0.25}Cu_{0.05\ to\ 0.06}Zr_{0.02\ to\ 0.03})_{7.0\ to\ 8.5}$. A silane coupling agent was added, a surface treatment was performed, and an aromatic nylon was blended as a resin. One end of the cylindrical magnetic core is coated with this mixed viscous material, as shown in FIG. 11A, and drying was performed. Magnetization was performed at 4 T (or more). The opening side of this magnetic core portion 147 was fitted to the coil portion 155 shown in FIG. 11C so as to produce the inductor component 145 shown in FIG. 11D.

EXAMPLE 11

Figure 12A:
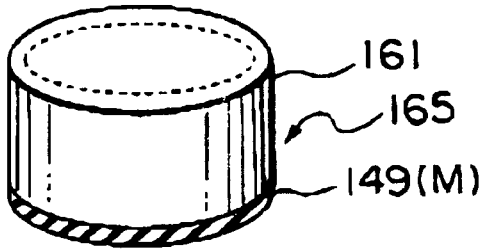
FIG. 12A is a perspective view showing a shape of a cap-shaped magnetic core of an inductor component according to Example 11 of the present invention.
Figure 12B:
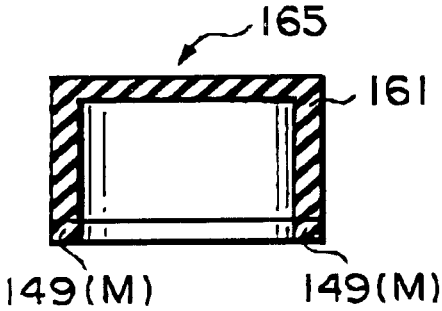
FIG. 12B is a sectional view of the magnetic core shown in FIG. 12A.

As shown in FIG. 12A, a permanent magnetic powder portion (M) 149 is coated (adhered) and dried on the joint (fitting) surface between a cap-shaped magnetic core portion 161 and the periphery collar 163*a* of a drum magnetic core 163. Subsequently, the permanent magnet portion (M) 149 (a mixture magnet of a magnetic powder and an adhesive) is magnetized together with the magnetic core portion 161, and is fixed so as to form a magnetic core 165 shown in FIG. 12B.

Figure 12C:
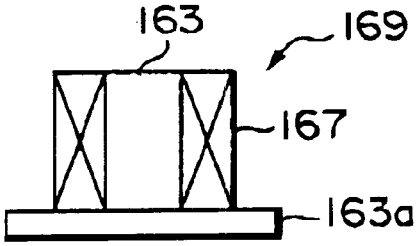
FIG. 12C is a side view of a coil portion of the inductor component according to Example 11 of the present invention.
Figure 12D:
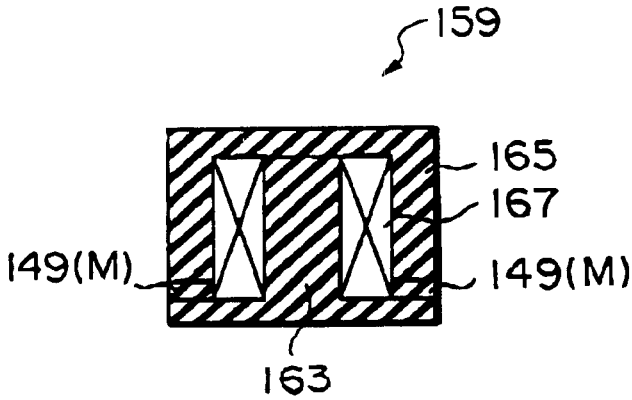
FIG. 12D is a sectional view of the inductor component according to Example 11 of the present invention.

As shown in FIG. 12C, a coil 167 is wound around a bobbin 163 made of a half-drum magnetic core and, therefore, a coil portion 169 is formed in advance. The coil portion 169 is covered with the magnetic core 165 so as to form an inductor component 159 composed of a transformer as shown in FIG. 12D.

Herein, materials similar to those in the configuration according to Example 10 can be used as the materials for the magnetic powder, resin, half-drum magnetic core portion 163, and cap-shaped magnetic core portion 161 according to Example 11 of the present invention.

As described above, regarding the inductor components 145 and 159 according to Examples 10 and 11 of the present invention, the processing steps can be simplified, and the gap (bias becomes invalid in the gap) between the magnetic core and permanent magnet can be reduced compared to a conventional process including adherence of a permanent magnet made of a ring-shaped thin plate manufactured in advance between magnetic cores Consequently, an inductor component can be realized with a bias effect (quality) improved to the full extent.

Regarding the inductor components 145 and 159 according to Examples 10 and 11 of the present invention, the amount of undesired air gap after combination of the magnetic cores can be made zero or very small by close adhesion of the magnetic powder to asperities on the joint surface between the magnetic cores 147, 153, 161, and 163 and the permanent magnet, and by the control of variations in the gap dimension due to cutting precision of the magnetic core gap, based on the amount of the permanent magnet powder.

In Examples 10 and 11 of the present invention, as described above, since the permanent magnet portion used is formed from the viscous material, no gap is generated and, therefore, the bias effect is further improved. In addition, adherence of the magnetic core and the permanent magnet becomes unnecessary in the manufacturing method (steps) and, therefore, the manufacturing steps can be simplified.

According to the present invention, irreversible demagnetization due to reflow soldering heat can be prevented, and demagnetization of the permanent magnet due to oxidation of the magnetic powder can be prevented by the use of the aforementioned magnetic powders, resins, surface coatings, and treatment materials.

As described above, regarding the inductor components according to Examples 10 and 11 of the present invention, since the magnetic powder adheres closely to asperities on the joint surface between the magnetic core and the permanent magnet, and variations in the gap dimension due to cutting precision of the magnetic core gap are controlled by the amount of the magnet powder of the permanent magnet, the amount of undesired air gap after combination of the magnetic cores can be made zero or very small. Consequently, the present invention can provide inductor components having no variation in the characteristics and can provide the manufacturing method therefor.

According to Examples 10 and 11, no gap is generated at the aforementioned joint portion and, therefore, the present invention can provide inductor components exhibiting a further improved bias effect and can provide the manufacturing method therefor.

According to Examples 10 and 11, adherence of the magnetic core and the permanent magnet becomes unnecessary in the manufacturing method (steps) and, therefore, the present invention can provide inductor components capable of simplifying the manufacturing steps, and can provide the manufacturing method therefor.

According to Examples 10 and 11, the present invention can provide inductor components capable of preventing irreversible demagnetization due to reflow soldering heat, and of preventing demagnetization due to oxidation of the magnetic powder constituting the permanent magnet by the use of the material having a specified composition and characteristic, and can provide the manufacturing method therefor.

What is claimed is:

1. An inductor component comprising:

a drum magnetic core made of a magnetic material having a structure including integrated flanges at both ends of a columnar material;

a coil wound around the columnar material in the drum magnetic core and placed between the flanges;

a permanent magnet placed in the a vicinity of the drum magnetic core; and a sleeve core fitted outside of the drum magnetic core;

wherein the permanent magnet is placed in at least one gap in a closed magnetic circuit formed with the drum magnetic core and the sleeve core in order to apply a direct-current magnetic field in a direction opposite to a direction of a magnetic field generated by a magnetomotive force due to the coil;

wherein the permanent magnet comprises a complex made by one of: (i) dispersing a magnetic powder in a resin, and (ii) mixing the resin and the magnetic powder, and wherein the magnetic powder is a rare-earth magnet powder having an intrinsic coercive force $H_c$ of at least $7.9\times10^5$ (A/m), a Curie temperature $T_c$ of at least 500° C., and an average powder particle diameter of 2.5 to 25 $\mu$m.

2. The inductor component according to claim 1, wherein the complex comprises a viscous material of the resin and the magnetic powder, and said viscous material is heat-cured after coating the gap therewith.

3. The inductor component according to claim 1, wherein the complex is formed at a position corresponding to the gap and magnetized together with a predetermined magnetic core selected from the drum magnetic core and the sleeve core.

4. The inductor component according to claim 1, wherein the complex is made by dispersing the magnetic powder in at least one resin selected from the group consisting of poly(amide-imide) resins, polyamide resins, epoxy resins, poly(phenylene sulfide) resins, silicone resins, polyester resins, aromatic polyamide resins, and liquid crystal polymers.

5. The inductor component according to claim 1, wherein a surface of the magnetic powder is coated with at least one metal selected from the group consisting of Zn, Al, Bi, Ga, In, Mg, Pb, Sb, and Sn or an alloy thereof.

6. The inductor component according to claim 5, wherein the coated magnetic powder is further coated with at least a nonmetallic inorganic compound having a melting point of at least 300° C.

7. The inductor component according to claim 6, wherein an added amount of the nonmetallic inorganic compound is within a range of 0.1% to 10% on a volume ratio basis.

8. The inductor component according to claim 1, wherein a content of the resin is at least 30% on a volume ratio basis, and a resistivity of the complex of the resin and the magnetic powder is at least 0.1 Ωcm.

9. The inductor component according to claim 1, wherein the magnetic powder has a composition of $Sm(Co_{bal}Fe_{0.15\ to\ 0.25}Cu_{0.05\ to\ 0.06}Zr_{0.02\ to\ 0.03})_{7.0\ to\ 8.5}$.

10. The inductor component according to claim 1, wherein the magnetic powder is coated with inorganic glass having a softening point of at least 220° C. and no more than 550° C.

11. The inductor component according to claim 10, wherein an added amount of the inorganic glass is within a range of 0.1% to 10% on a volume ratio basis.

12. The inductor component according to claim 1, wherein the magnetic powder is surface treated with one of a silane coupling agent, a titanium coupling agent, and a dispersing agent before being one of: (i) mixed with the resin and (ii) dispersed in the resin.

13. The inductor component according to claim 1, wherein the permanent magnet is made by orientating the magnetic powder in a thickness direction with a magnetic field so as to have magnetic anisotropy.

14. The inductor component according to claim 1, wherein the magnetizing magnetic field of the permanent magnet is at least 2.5 T.

15. The inductor component according to claim 1, wherein the permanent magnet has a center line average roughness Ra of no more than 10 $\mu$m.

* * * * *